US007374370B2

(12) United States Patent
Morris

(10) Patent No.: US 7,374,370 B2
(45) Date of Patent: May 20, 2008

(54) ROCK BOLT ANCHOR HAVING CONCURRENT CHEMICAL AND MECHANICAL ANCHORING MEANS AND METHOD FOR USING THE SAME

(76) Inventor: Wilfred G. Morris, 390 St. Louis Avenue, Pointe Claire, Quebec (CA) H9R 2A2

( * ) Notice: Subject to any disclaimer, the term of this patent is extended or adjusted under 35 U.S.C. 154(b) by 0 days.

(21) Appl. No.: 11/028,448

(22) Filed: Jan. 4, 2005

(65) Prior Publication Data

US 2006/0013657 A1 Jan. 19, 2006

(51) Int. Cl.
*E21D 20/02* (2006.01)

(52) U.S. Cl. ..... 405/259.6; 405/259.4; 411/65; 411/72

(58) Field of Classification Search .. 405/259.1–259.6; 411/63–68, 72
See application file for complete search history.

(56) References Cited

U.S. PATENT DOCUMENTS 2,829,502 A * 4/1958 Dempsey ..... 405/259.6
2,952,129 A * 9/1960 Dempsey ..... 405/259.6
3,702,060 A * 11/1972 Cumming ..... 405/259.6
4,380,407 A * 4/1983 Donan, Jr. ..... 405/259.3
4,497,403 A * 2/1985 Rausch ..... 206/219
4,516,886 A * 5/1985 Wright ..... 405/259.6
4,861,198 A * 8/1989 Stankus ..... 405/259.3
5,052,861 A * 10/1991 Hipkins, Sr. ..... 405/259.6
5,098,227 A * 3/1992 Wright ..... 405/259.6
5,219,248 A * 6/1993 Wright ..... 405/259.4
5,222,835 A * 6/1993 Wright ..... 405/259.6
5,344,257 A * 9/1994 Wright et al. ..... 405/259.4
5,762,451 A * 6/1998 Stankus et al. ..... 405/259.1
5,846,041 A * 12/1998 Bevan et al. ..... 411/65
6,146,055 A * 11/2000 White ..... 405/259.4
6,698,980 B2 * 3/2004 Mongrain ..... 405/259.5

* cited by examiner

*Primary Examiner*—Tara L. Mayo

(57) ABSTRACT

A rock bolt anchor includes a top portion permanently fixed to a bottom portion. The top portion carries a package of resin. A spring-loaded mechanism pressurizes the package and forces the resin out when the package is lanced. The bottom portion main body carries a pair of opposed outer shells in a dovetail joint on opposed tapers. The annulus adjacent to the rock bolt anchor is sealed by top and bottom bulkheads. The bottom portion is threaded onto a rock bolt. A hollow and ported lance is threaded onto the exposed end of the rock bolt. The combination is inserted into a drilled hole and the rock bolt rotated. The lance rises and pierces the package releasing into the sealed annulus. Continued rotation of the rock bolt, forces the main body down and the outer shells up the tapers compressing them against the wall of the drilled hole.

18 Claims, 18 Drawing Sheets

ROCK BOLT ANCHOR HAVING CONCURRENT CHEMICAL AND MECHANICAL ANCHORING MEANS AND METHOD FOR USING THE SAME

CROSS-REFERENCE TO RELATED APPLICATIONS

This application claims the benefit of my co-pending Canadian patent application entitled "Dual Mechanical & Resin Anchor Bolt" filed in the Canadian Intellectual Property Office on Jun. 30, 2004 and having a serial number of 2,470,212.

REFERENCE TO MICROFICHE APPENDIX

Not applicable.

BACKGROUND OF THE INVENTION

1. Field of the Invention

This invention relates to a rock stabilizing apparatus for anchoring unstable rock formations in underground mines and construction sites and more particularly relates to an apparatus and method that concurrently employs both chemical and mechanical anchor means to anchor a rock bolt within an unstable rock formation.

2. Background of the Invention

It is well known in mining and construction operations to reinforce roofs, sides and floors of tunnels and shafts using rock bolting. The rock bolts are inserted into a drilled hole and are anchored in place chemically by either a quick curing resin-based adhesive material or mechanically by such devices as expanding anchors adapted to frictionally engage the wall of a drilled hole. Examples of both methods are found in U.S. Pat. Nos. 6,146,055, 6,698,980 5,344,257 and 5,219,248.

Using a concurrent combination of mechanical and chemical anchors to anchor a rock bolt in a drilled hole is also known in the art and has the combined advantages associated with each individual method. One such device is described in U.S. Pat. No. 5,222,835 "Resin-Mixing Article for Mine Roof Anchor" issued to Wright on Jun. 29, 1993. However, Wright does not teach an integrated chemical-mechanical anchor, but rather describes a device where the resin package is placed in the drilled hole in advance of the rock bolt and then the rock bolt is inserted to pierce the package and permit the resin to flow around a portion of the rock bolt. Mechanical anchoring means in the form of a conventional expanding anchor assembly is then used to anchor the rock bolt. The Wright invention discloses a number of weaknesses in combined chemical-mechanical rock bolt anchoring systems. First of all, the Wright invention does not keep the resin material within a predefined portion of the annulus between the rock bolt and the wall of the drilled hole. The resin is permitted to flow around the rock bolt in an uncontrolled manner and back down the drilled hole until such a time as the resin has sufficiently cured to prevent flow. This can have the result of creating voids within the resin material and wasting resin adhesive that may flow down the drilled hole and merely coat the wall of the drilled hole rather than anchor the rock bolt to the wall of the drilled hole. The effect is that the total adhesive capability of the resin is not achieved. Secondly, the resin package is inserted into the drilled hole in advance of the rock bolt. This means that the resin package could be damaged during insertion and tamping to the top of the hole.

Resin leakage will again result in the reduction of resin adhesive capability.

Therefore there is a requirement to provide an apparatus that integrates both chemical and mechanical bonding means into rock bolt anchor, takes full advantage of the total adhesive capabilities of the adhesive material and protects the resin package from damage before it needs to be ruptured. There is also a further need to provide for a mechanical anchoring means that can be adapted with an integral chemical anchoring means for use in fragmented rock formations.

OBJECTS OF THE INVENTION

It is an object of this invention to provide a rock bolt anchor having both chemical and mechanical anchoring means that overcomes the disadvantages associated with the prior art.

It is a further objective of this invention to provide a rock bolt anchor that has the effect of controlling the flow of resin adhesive so that the resin adhesive is confined to a specific area of the annulus thereby taking full advantage of the binding capabilities of the resin.

It is yet a further objective of this invention to provide a rock bolt anchor that combines a mechanical anchoring system with a chemical anchoring system in a cooperative fashion.

Still another objective of the invention to provide a rock bolt anchor that is well suited to fragmented rock formations.

SUMMARY OF THE INVENTION

My invention seeks to resolve the disadvantages associated with the prior art and meet the objectives stated herein by providing a rock bolt anchor that uses a combination of chemical and mechanical means to fix a rock bolt into a drilled hole. The rock bolt anchor is attached to the threaded end of a rock bolt and inserted snuggly into a drilled hole in a rock formation forming an adjacent annulus between the wall of the drilled hole and the rock bolt anchor. The rock bolt anchor comprises a top portion and a bottom portion. The top portion contains the chemical means for anchoring the rock bolt into the drilled hole. It consists of a spring loaded resin release mechanism that is adapted for containing a package of adhesive resin for injection into the annulus between a top and bottom bulkhead. The package of resin is pressurized so that once it is pierced; the adhesive resin is forced from the package into the annulus between the bulkheads thereby fixing the rock bolt within the drilled hole. The bottom portion contains the mechanical means for anchoring the rock bolt into the drilled hole. The mechanical means includes a main body that supports a pair of outer shells that are forced into a gripping contact with wall of the drilled hole. The main body includes a central bore that is threaded with a standard thread for receiving the threaded top end of the rock bolt. In another embodiment of my invention, the threaded bore of the main body may have multiple threads to increase the speed at which the rock bolt passes through the main body and speed up the overall rock bolting process. Under certain circumstances, the time taken for a specific rock bolting process may halved using multiple threads over standard threads.

One further advantage offered by my invention is that if the user wishes to inject a grouting material into the drilled hole then the main body bottom end has a standard ¾ inch thread that can be connected to source of grout for that purpose.

The spring loaded release mechanism comprises a first and second bail each having a circular center portion and a pair of legs extending downwards. The legs of the first bail permanently connect the top portion of the rock bolt anchor to the bottom portion of the rock bolt anchor at the top of the main body. The legs of the second bail are shorter and cooperate with the legs of the first bail to form an open chamber for carrying a package of adhesive resin. The spring loaded release mechanism has a first retracted position maintained by a wing nut to permit the resin package to be inserted into the chamber. The rock bolt anchor is threaded onto the end of a rock bolt and a package of resin is inserted into the chamber. Prior to inserting the rock bolt and anchor combination into the drilled hole, the wing nut is removed thereby freeing the spring loaded release mechanism to act against the package of resin pressurizing it. The rock bolt and anchor combination is inserted into the drilled hole. Once the resin package is punctured, the spring loaded release mechanism forces the resin out of the package and into the annulus between the bulkheads.

The bottom portion of the rock bolt anchor consists of a main body having opposed upwardly tapered sections, a pair of outer shells carried on the opposed upwardly tapered sections of the main body, a third bail and a hollow ported lance. The outer shells are held on the main body by a unique dove-tail joint. The third bail has a circular center portion with a hole and a pair of legs that first extend downwards and then taper inwards. The end of each leg is attached to the top of one of the outer shells. The third bail also has a pair of anti-rotation tabs that prevent the anchor bolt from rotating as the rock bolt is rotated. The hollow ported lance and the main body are threaded onto the end of the rock bolt. One further advantage of invention is that the main body has a multiple thread so that when the rock bolt is rotated, the threads of the rock bolt thread the main body significantly faster than a single thread would allow. This feature significantly cuts rock bolt installation time by up to 50%.

To install the combined rock bolt anchor and rock bolt into a drilled hole, the main body is threaded onto the end of the rock bolt. The rock bolt threads advance through the main body so that two or three threads extend beyond the top surface of the main body. The hollow ported lance is then threaded onto the end of the rock bolt. This secures the rock bolt anchor to the rock bolt. The wing nut is removed from the spring loaded resin release mechanism to pressurize the resin package. The combination rock bolt and rock bolt anchor are inserted into the drilled hole to a desired location. Then the rock bolt is rotated. The standard threads on the main body advances the rock bolt through the main body so that the lance on the end of the rock bolt moves through the hole in the third bail and into piercing contact with the resin package. Then the spring loaded resin release mechanism operates to force the resin through the hollow lance out of the ports and into the annulus between the bulkheads. The rock bolt continues to advance with three dynamic results. Firstly, the top portion of the rock bolt anchor separates from the bottom portion of the rock bolt anchor. Secondly, the rotating advancing rock bolt threads through the main body and acts on the third bail forcing it upwards. Thirdly, the main body is forced down the threaded rock bolt. The second and third results cause the outer shells carried on the main body and the main body itself to move in opposite directions. Hence, the shells move along the tapers of the main body and are forced outwards into a gripping contact with the wall of the drilled hole thereby forming the rock bolt mechanical anchor. The threefold holding power of my anchor is as follows: (1) the serrated shells are forced laterally against the bore hole wall; (2) the solidifying resin fully encapsulates the rock anchor including the exposed threaded section in the bore hole; and, (3) the taper design of the main body wedges the now solidified resin in the space formally occupied by the shell before separation.

The combined chemical and mechanical anchor of my invention results in three-times the holding strength of a conventional anchor. My invention is well suited to applications such as anchoring fragmented rock and coarse grained material such as concrete.

BRIEF DESCRIPTION OF THE DRAWINGS

The invention will be more readily understood by reference to the following description, taken with the accompanying drawings, in which.

DETAILED DESCRIPTION

Figure 1:
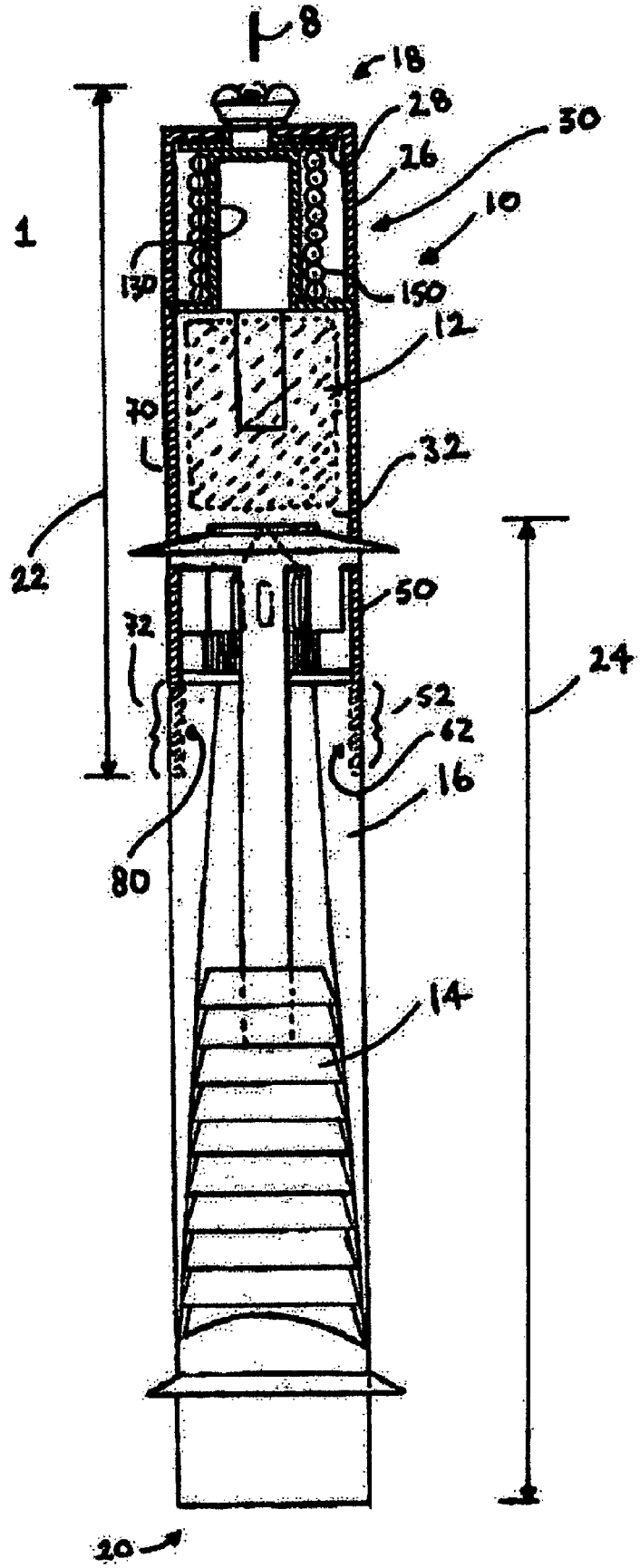
FIG. 1 illustrates one embodiment of my invention in partial cross-section.

Referring now to FIG. 1, there is illustrated a preferred embodiment of my invention. My invention (10) is a rock bolt anchor having a combination of chemical means for fixing the rock bolt inside of a drilled hole and mechanical means for fixing the rock bolt inside of a drilled hole. The chemical means is a package of adhesive resin (12) shown in ghost lines. The mechanical means is a pair of opposed outer shells (14) carried by a main body (16). A major advantage and innovative feature of my invention is the combined chemical and mechanical means for anchoring the rock bolt which results in a three fold increase in anchoring strength over conventional anchoring means. The operation of both the chemical means and mechanical means will be more fully explained below.

Still referring to FIG. 1, for purpose of this description, the rock bolt and rock bolt anchor will always be considered to be oriented up (top of the page) and down (bottom of the page) as if inserted vertically into the roof of a mine. Hence the rock bolt anchor will have a top end (18) and a bottom end (20). My invention has a top portion (22) and a bottom portion (24). The top and bottom portions appear to overlap in FIG. 1 because the legs of the first bail of the top portion are used to connect the top portion to the bottom portion as more fully explained below.

General Components and Construction of the Top Portion

The top portion (22) comprises the following components: a first bail (26), a second bail (28) co-axial with the first bail and a spring loaded resin release mechanism generally shown as (30) and will be described in greater detail below. In FIG. 1, the spring loaded resin release mechanism is shown in a pre-insertion and retracted state which permits the insertion of the resin package (12) into the open chamber (32).

Figure 2:
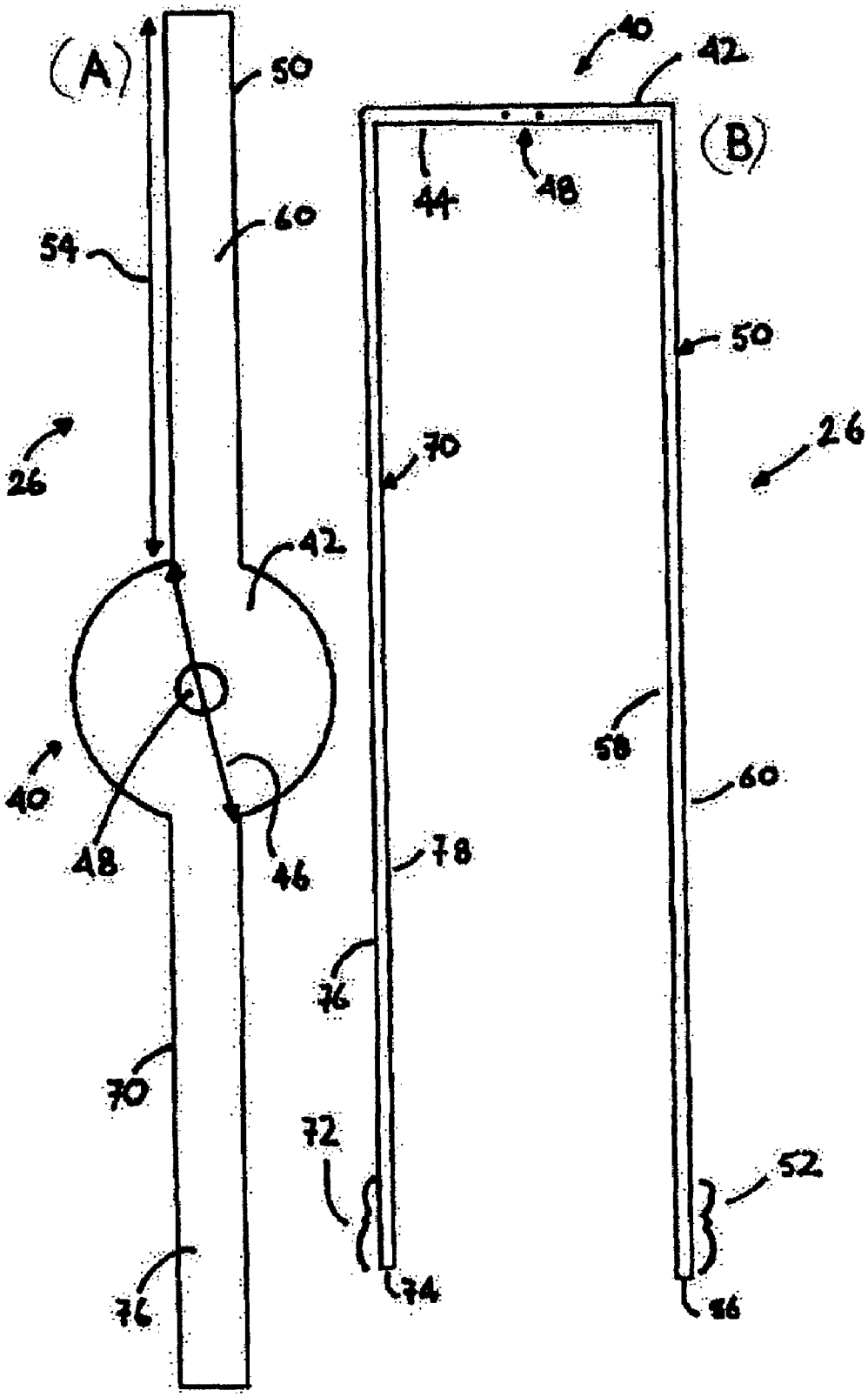
FIG. 2 comprises two illustrations of the first bail of one embodiment of my invention.

Referring now to FIG. 2 there is shown in illustration A the first bail (26) as it would appear when stamped from appropriate stock material using a cutting form. A person skilled in the art of manufacture would know that stamping these metal parts one of the more cost-effective ways to manufacture them in bulk and so the further description of how each part of the rock bolt anchor is manufactured is not required here. A person skilled in the art would also know that, unless otherwise stated herein, the first bail and all other parts of my invention would be made from a suitable steel alloy material with a thickness and strength sufficient to withstand the forces to be the exerted during the rock bolting process. In illustration B the first bail (26) is shown in its formed configuration for installation in the rock bolt anchor top portion. Illustration A and B are not drawn to the same scale. The first bail comprises a flat circular middle portion (40) placed across the longitudinal axis (8) of the rock bolt anchor. The flat circular middle portion (40) has an upper surface (42), a bottom surface (44), a diameter (46), and a first bail aperture (48) centered on the longitudinal rock bolt anchor axis (8). There is a first pair of opposed legs comprising a first leg (50) having a lower engagement portion (52), a length (54), a bottom tip (56), an inside surface (58) and an outside surface (60).

Referring back to FIG. 1, the first leg (50) extends vertically downwards from the flat circular middle portion and the first leg lower engagement portion (52) is adapted for permanent placement within notch (62) in the main body (16) for fixing permanently the rock bolt anchor top portion (22) to the rock anchor bolt bottom portion (24) by spot welding.

Referring back to FIG. 2, there is also an opposite second leg (70) having a lower engagement portion (72), a length equal to first leg length (54), a bottom tip (74), an outside surface (76) and an inside side surface (78).

Referring back to FIG. 1, the second leg extends vertically downwards from the flat circular middle portion and the second leg lower permanent engagement portion (72) is also adapted for placement within notch (80) by spot welding to permanently fix the top portion of the anchor to the bottom portion.

Figure 3:
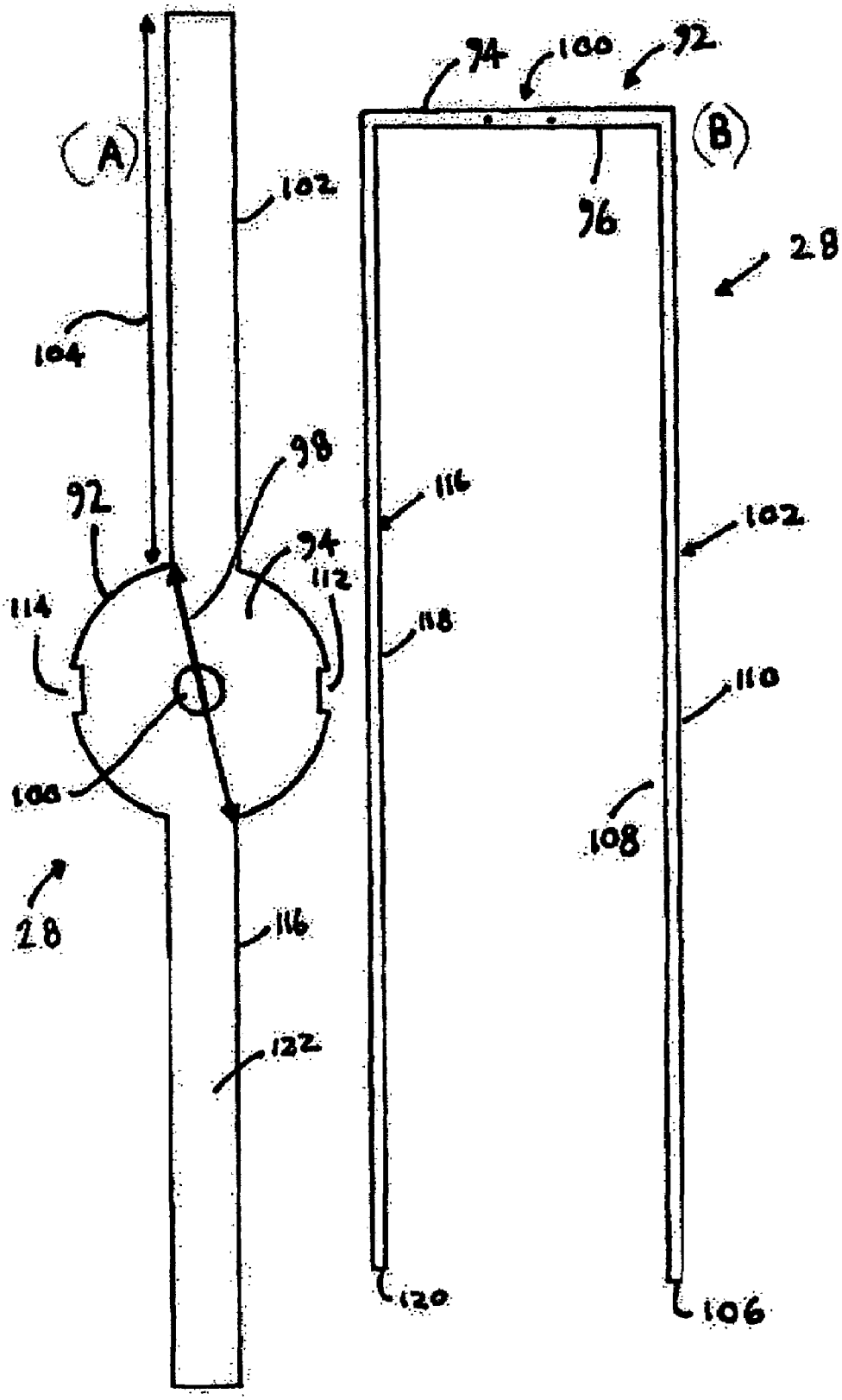
FIG. 3 comprises two illustrations of the second bail of one embodiment of my invention.

Referring now to FIG. 3 there is shown in illustration A the second bail (28) as it would appear when stamped using a cutting form. Illustration B shows the second bail (28) in its formed configuration for installation in the rock bolt anchor top portion. The second bail comprises a flat circular middle portion (92) placed across the longitudinal axis (8) of the rock bolt anchor. The flat circular middle portion (92) has an upper surface (94), a lower surface (96), a diameter (98) that is substantially equal to diameter (46), and a second bail aperture (100) centered on the longitudinal rock bolt anchor axis (8). There is a second pair of opposed legs comprising a first leg (102) having a length (104) that is substantially shorter than length (54), a bottom tip (106), an inside surface (108) and an outside surface (110). The first leg extends vertically downwards from the flat circular middle portion. There is a second leg (116) identical to the first leg (102) having an inside surface (118), a tip (120) and an outside surface (122). The second bail top portion includes notch (112) and notch (114) which are adapted to receive the inside surfaces (108) and (118) of the first pair of opposed legs (102) and (116).

Referring back to FIG. 1, second bail (28) is oriented below first bail (26) so that the first and second pairs of opposed legs are oriented at a right angle to each other. This orientation forms the four sided open chamber (32) in which is protectively placed the resin package (1 2). The purpose of the notches (112) and (114) will become apparent with the description of the spring loaded resin release mechanism (30).

Figure 4:
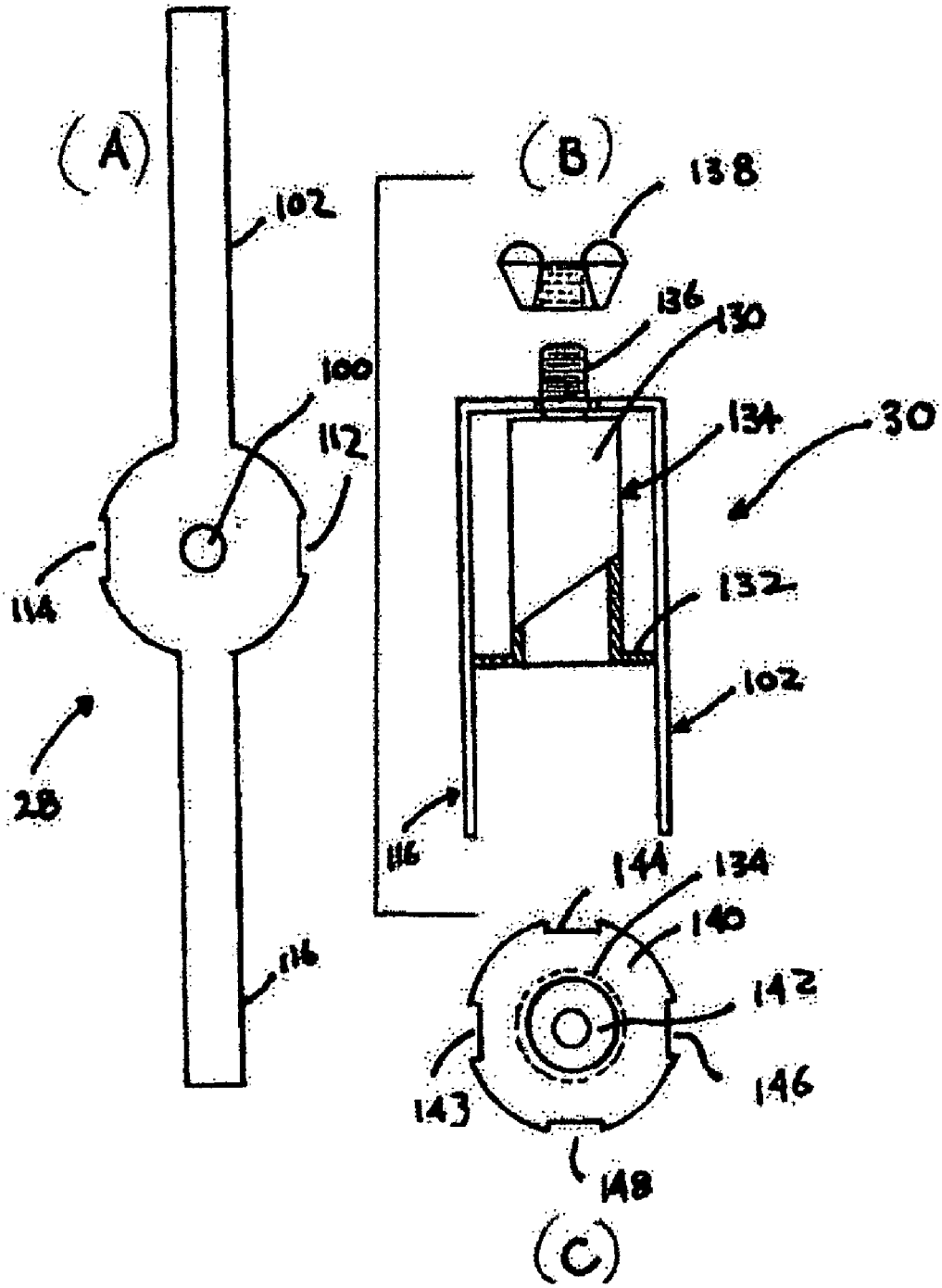
FIG. 4 comprises a view of spring loaded resin release mechanism of my invention.

Referring now to FIG. 4, there is shown the components comprising the spring loaded resin release mechanism generally shown as (30). The spring loaded resin release mechanism comprises second bail (28) (Illustration A) having aperture (100) notches (112) and (114) and legs (102) and (116) and first bail (26) not shown here so that the mechanism can be viewed. Referring back to FIG. 1, the relationship between the first and second bails is clear. The spring loaded resin release mechanism includes a top-hat shaped member (130) shown in partial cross-section in Illustration B. The member (130) includes a lower circular flange (132) and an upper cylindrical portion (134). Fixed to the top centre of the cylindrical portion is the first end of a threaded stem (136) having a free end adapted to receive a wing nut (138). The threaded stem receives the second bail aperture (100) and the first bail aperture (48). The top hat-shaped member sits within the four sided open chamber. Illustration C views the bottom of member (130) showing bottom (140) of flange (132) the inside (142) of the cylindrical portion (134) and four notches (143), (144), (146), and (148). The four notches are adapted to receive in a sliding relationship the inside surfaces of the first and second pair of opposed legs so that the circular flange is guided up and down within the open chamber by the first and second pairs of opposed legs.

Figure 15:
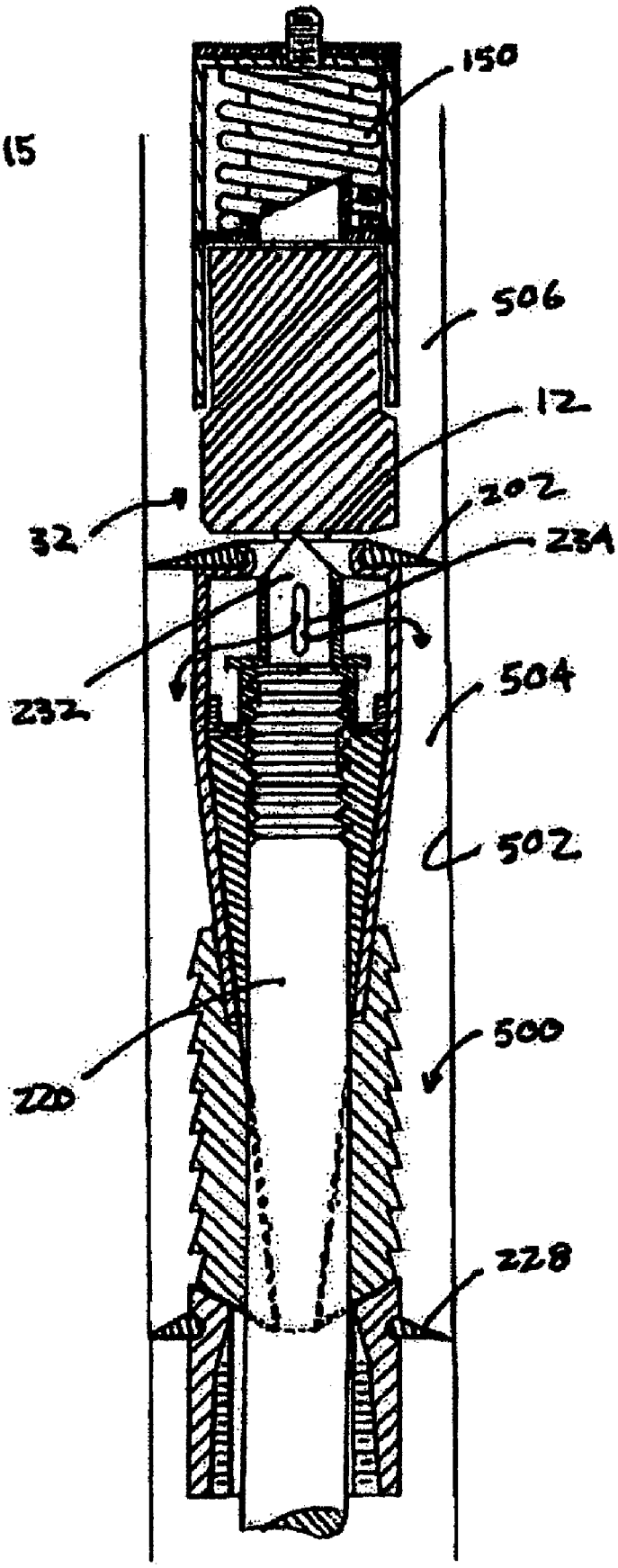
FIG. 15 is an illustration of my invention inserted into a drilled hole in a rock formation prior to rotation of the rock bolt.
Figure 16:
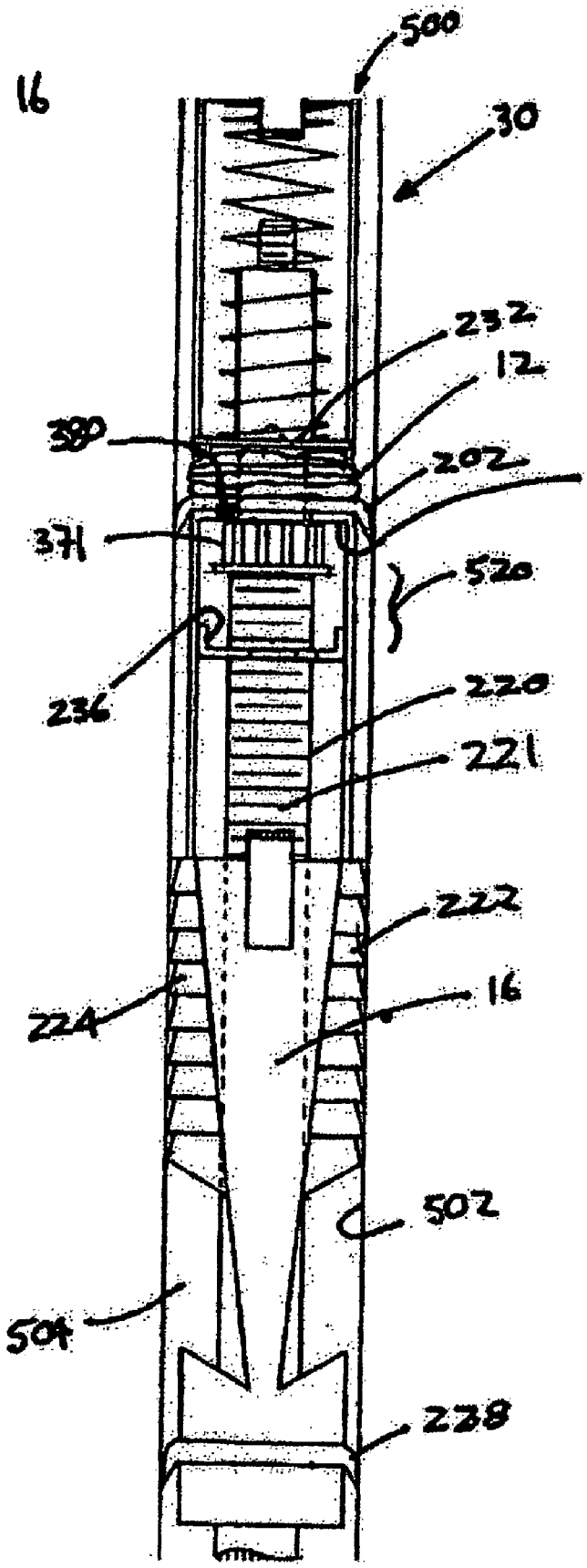
FIG. 16 is an illustration of my invention in a drilled hole after the rock bolt has been rotated.

Referring back to FIG. 1, member (130) is shown in cross-section and spring (150) is shown disposed around member (130) cylindrical portion (134). The top surface of the spring abuts against the bottom surface of the second bail flat circular middle portion and the bottom of the spring abuts against the top surface of the lower circular flange. FIG. 1 also illustrates that notches (143) and (146) slidingly engage the inside surfaces of second bail legs (102) and (116) and notches (144) and (148) slidingly engage the inside surfaces of first bail legs (50) and (70). It is clear that the legs of the first and second bails act as guides for member (130). In FIG. 1, wing nut (138) is threaded onto stem (136) and spring (150) is compressed so that the member (130) is in its first retracted position. This permits the placement of resin package (12) within the chamber (32). Obviously, once the wing nut is removed and the spring released, the bottom surface of member (130) will compress the resin package (12) thereby pressurizing its contents. Once the resin package is pierced as more fully explained below, member (130) will travel down the guide legs and force all of the resin out of the package. FIG. 1 illustrates the spring loaded resin release mechanism in its first operating state with the spring compressed and the flange retracted. FIG. 15 shows the mechanism in its second operating state with the wing nut removed and the spring released to compress the package of resin prior to insertion into the drilled hole. FIG. 16 shows the mechanism in its third operating state wherein the resin package has been pierced and the spring fully extended in the open chamber.

General Components and Construction of the Bottom Portion

Figure 5:
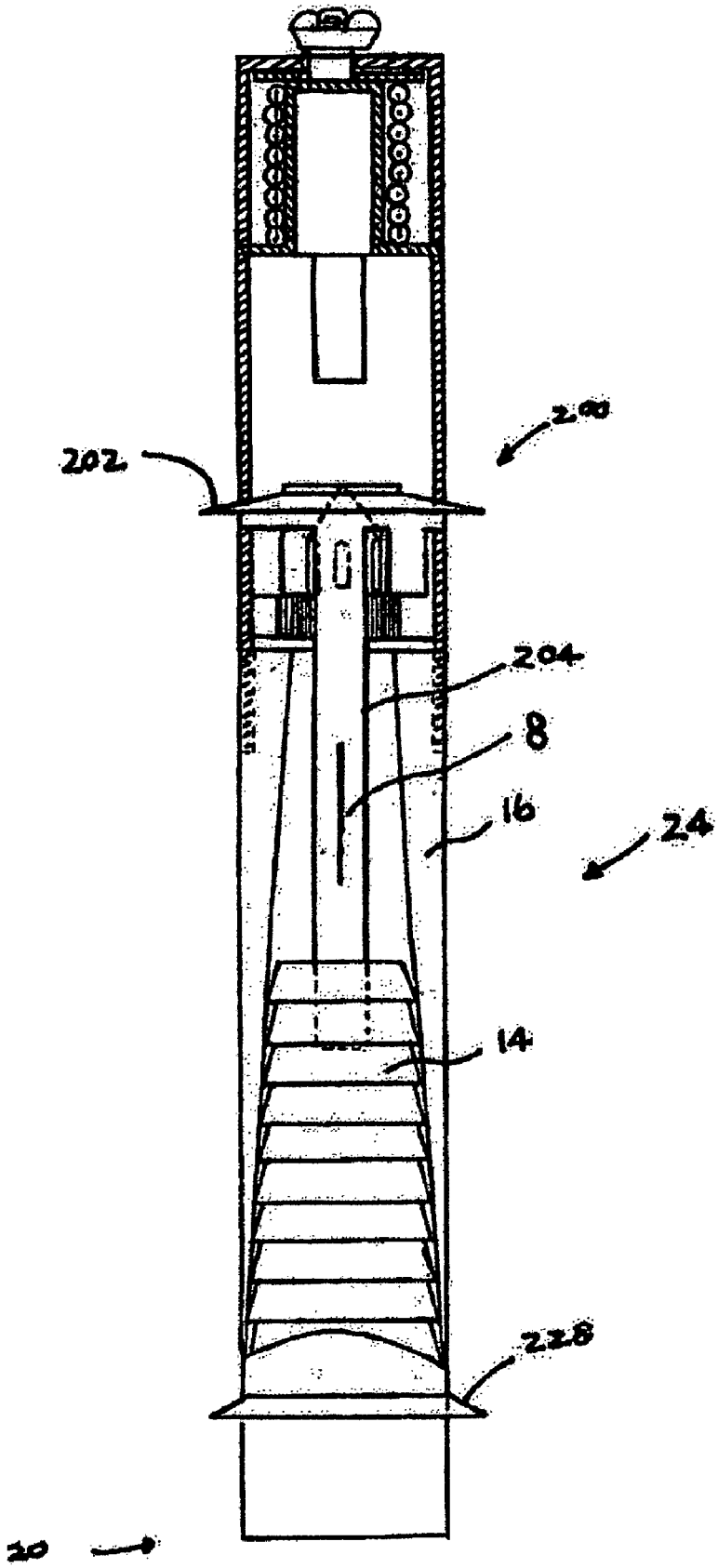
FIG. 5 is the same embodiment of my invention as FIG. 1.
Figure 6:
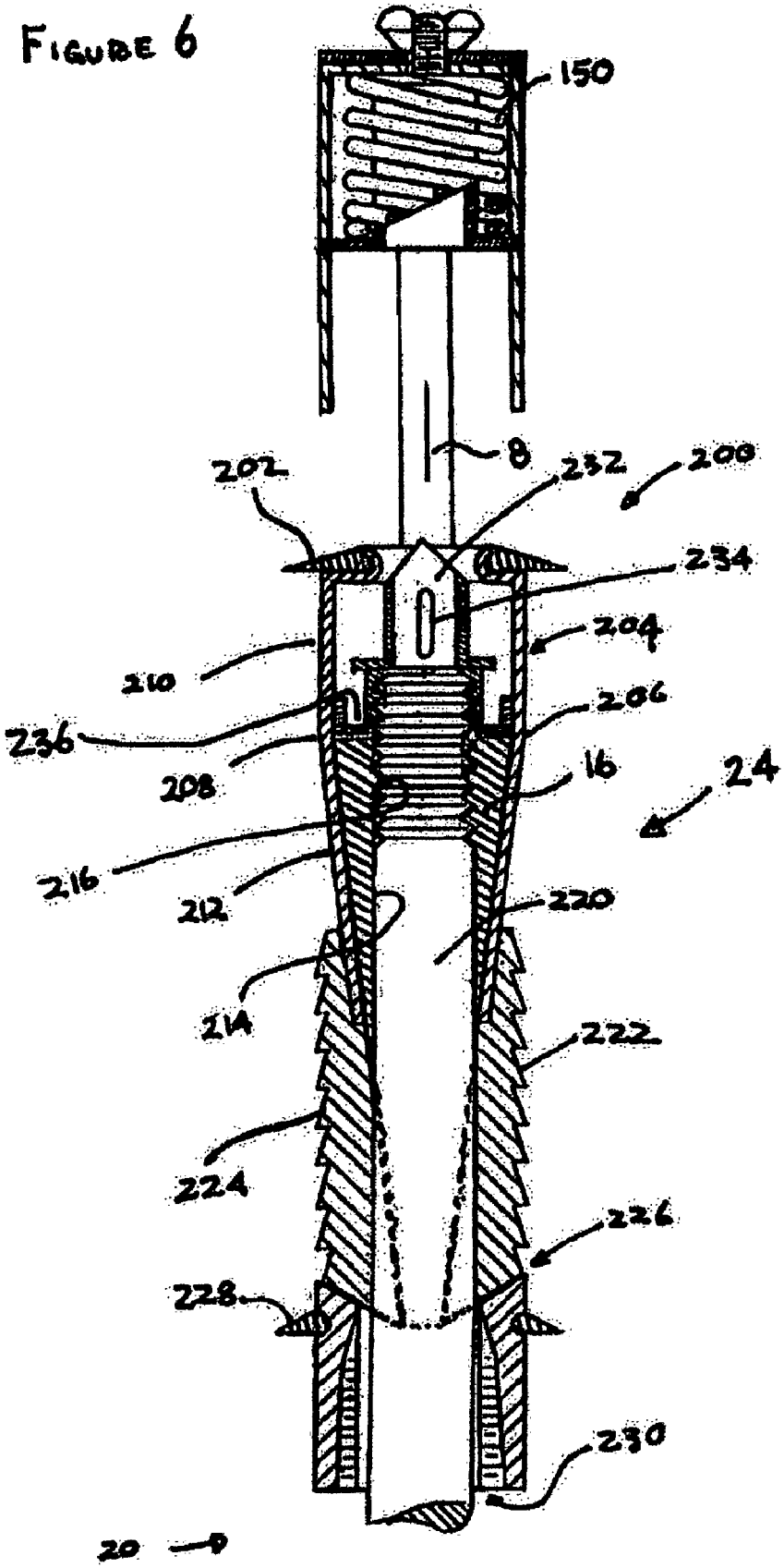
FIG. 6 is a cross-section side view of one embodiment of my invention illustrating additional detail of the bottom portion.

Refer now to FIG. 5 and FIG. 6. FIG. 5 is identical to FIG. 1 except that the resin package is removed. FIG. 5 and FIG. 6 again illustrate the relationship between the top portion of the rock bolt anchor and its bottom portion. As well, FIG. 6 shows more fully the spring (150) and shows the bottom portion in cross-section. FIG. 5 and FIG. 6 illustrate the same embodiment of the invention except that the illustration in FIG. 6 is rotated 90 degrees around axis (8).

Starting from the top (200) of the bottom portion (24) and working towards the bottom (20) of the bottom portion the various components of the bottom portion are identified. There is top bulkhead (202) for sealing the top of the annulus between the anchor and the drilled hole wall when the anchor and rock bolt combination is inserted into the drilled hole. There is a third bail (204) having a pair of legs (206) and (208) that each have a first vertical portion (210) and a second inclined portion (212). There is main body (16) having a bore (214) having an upper threaded portion having standard threads in the preferred embodiment to pass the threaded end of the rock bolt (220) as it is rotated. In alternate embodiments of my invention the threads may be multiple threads. There is the pair of opposed outer shells (14) comprising a first shell (222) and a second shell (224). Note that third bail (204) legs (206) and (208) are fixed to the top of each shell (222) and (224) respectively. The pair of opposed shells are carried on the main body in a unique dove tail joint (226). The bottom portion of the main body carries the bottom bulkhead (228) which seals the bottom of the annulus when the anchor is inserted into the drilled hole. The bottom portion also includes lance (232) for piercing the package of resin. One advantage of my invention is that the bottom portion has an inside surface (230) which is threaded with a 34 inch thread to permit attachment to a grouting source for grouting operations as necessary. Fixed to the top of the rock bolt (220) is lance (232) which is hollow and ported (234). Below the lance (232) is baffle member (236) attached to the third bail (204).

The Main Body

Figure 7:
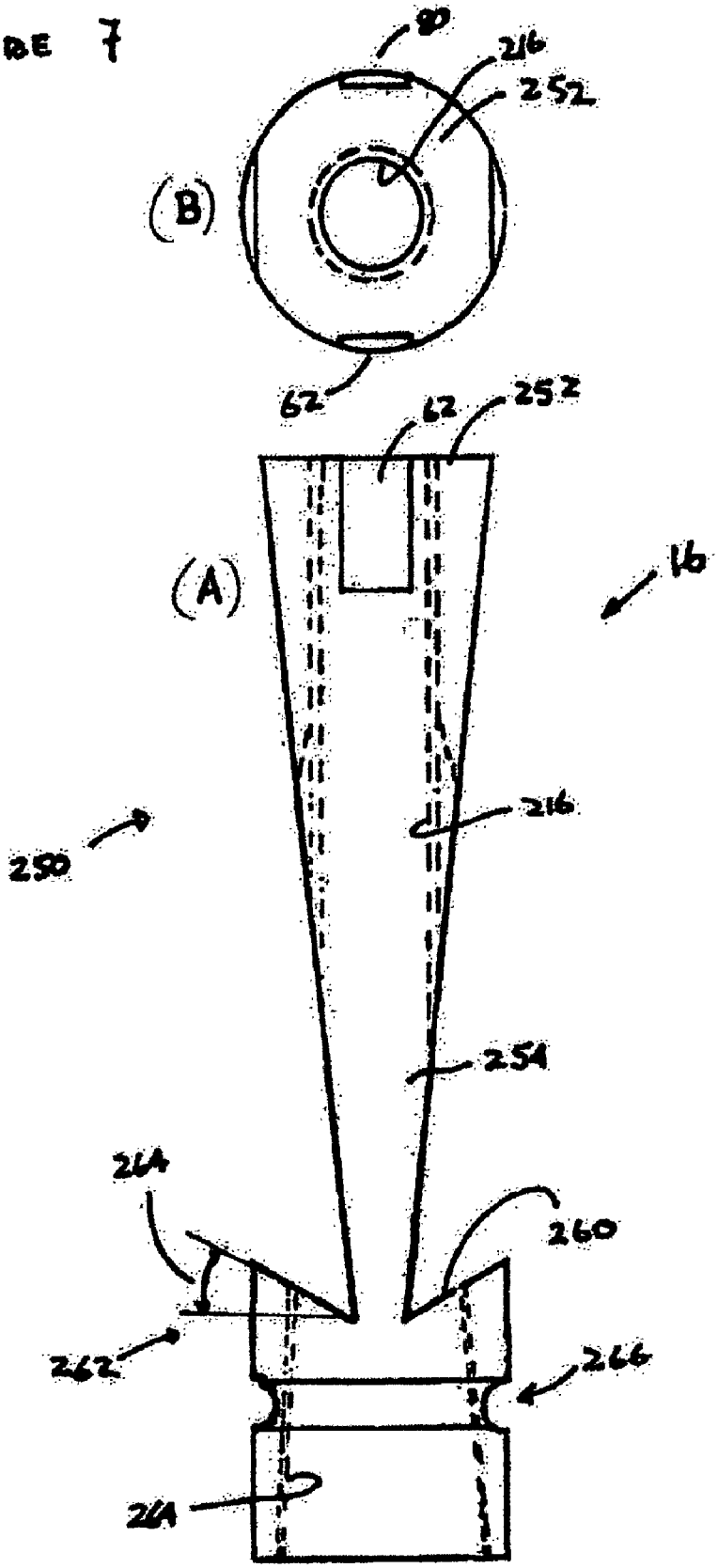
FIG. 7 is a view of the main body of my invention.
Figure 8:
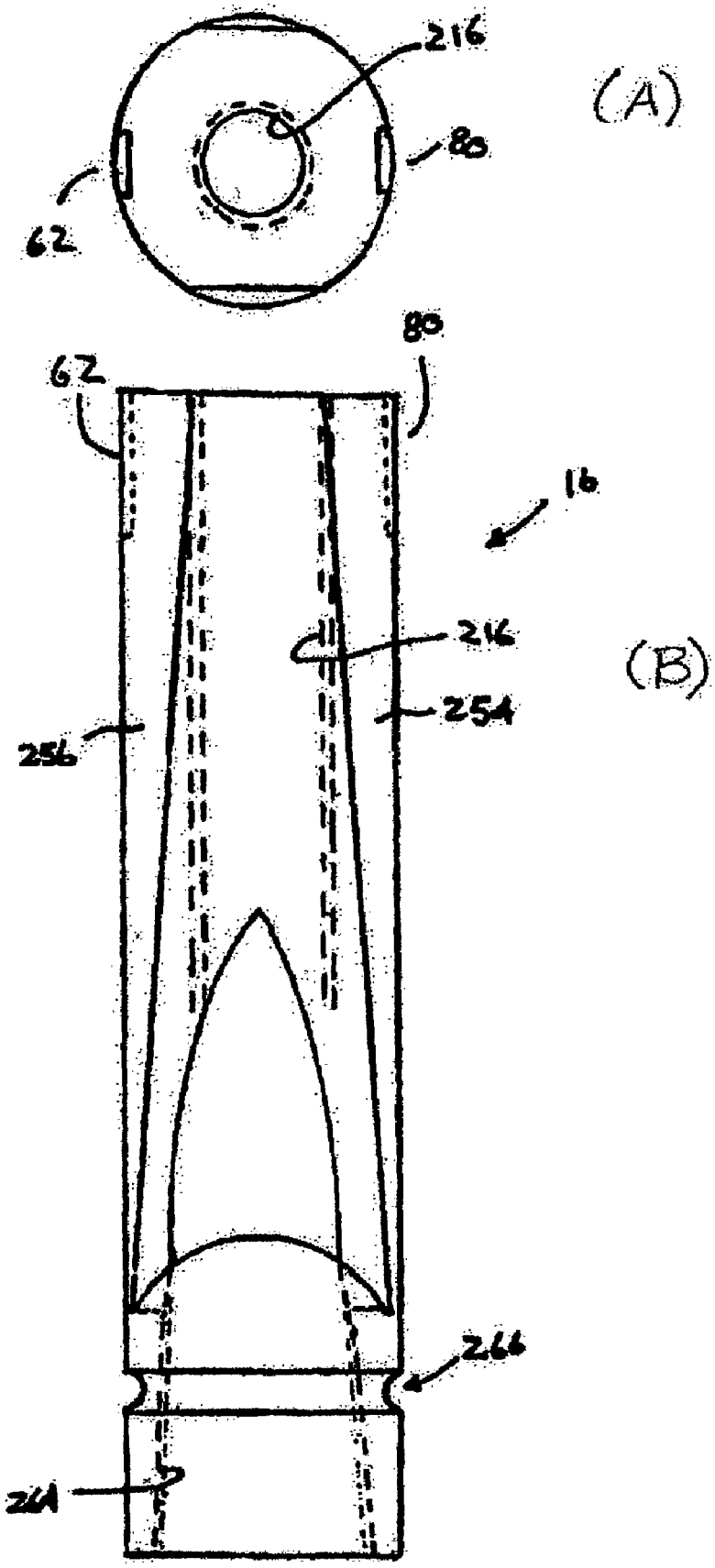
FIG. 8 is a view of the same main body of FIG. 7. but turned 90 degrees about its longitudinal axis.

Referring now to FIG. 7 and FIG. 8 the main body (16) will be described in more detail. In FIG. 7 Illustration A is a side view of main body (16) and Illustration B is a top view of main body (16). The top portion (250) of main body (16) is a casted body comprising a flat circular top surface (252) and a pair of opposed tapers (254) and (256) commencing at the top surface (252) and depending a predetermined distance to the top surface (260) of the bottom portion (262) of the main body. The tapers terminates in a dove tail which angles the top surface (260) outwards and upwards at a predetermined angle (264). The bottom portion (262) of the main body below the dove tail includes a groove (266) adapted to carry the lower bulkhead and incorporates a ¾ inch pipe thread (264) for grouting purposes. The dove tail design creates an interlocking ability with the pair of outer shells to hold the outer shells on the main body.

Referring to FIGS. 1, 7 and 8, the bottom engagement portions (52) and (72) of the first pair of opposed legs (50) and (70) are adapted to be permanently fixed in notches (62) and (80) on the main body by spot welding.

Referring to FIGS. 6, 7 and 8, rock bolt (220) is threaded into the main body (16) by way of internal threads (216) which are standard threads in the preferred embodiment to pass the rock bolt through the main body.

The Outer Shells

Figure 9:
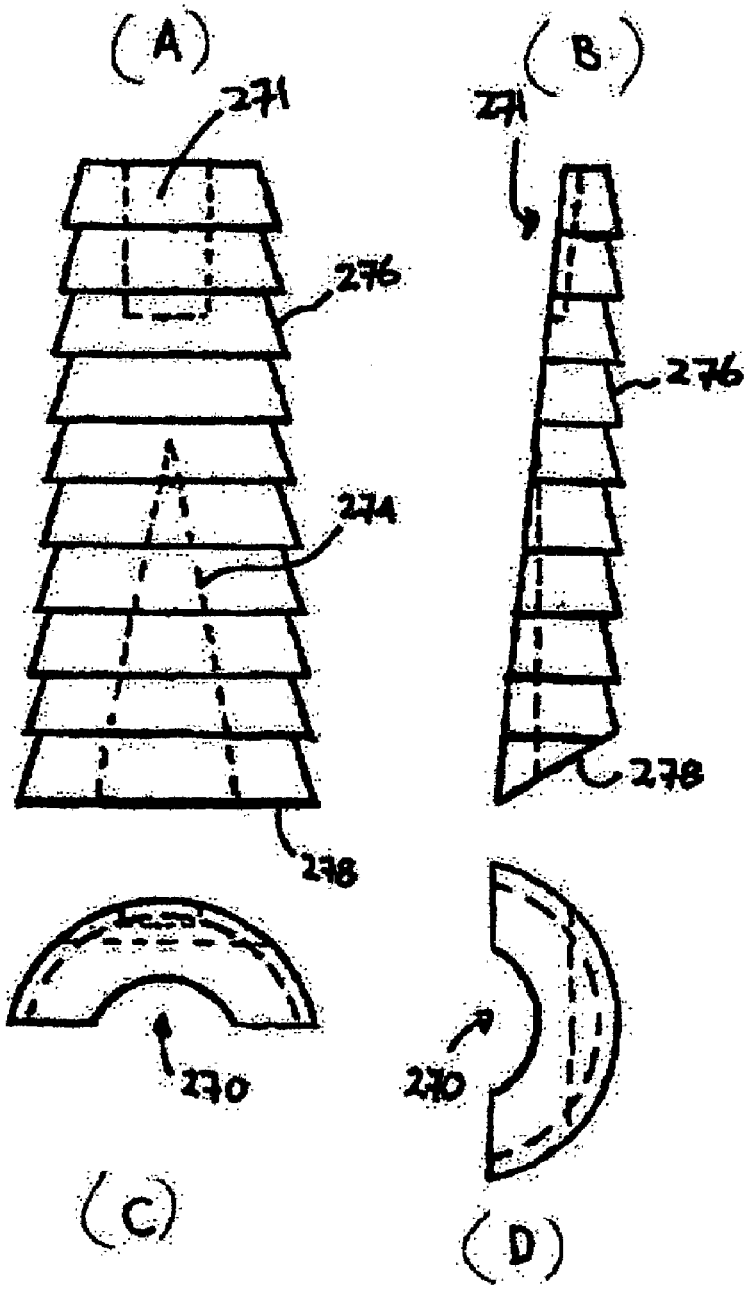
FIG. 9 comprises illustrations of one of the outer shells of one embodiment of my invention.
Figure 10:
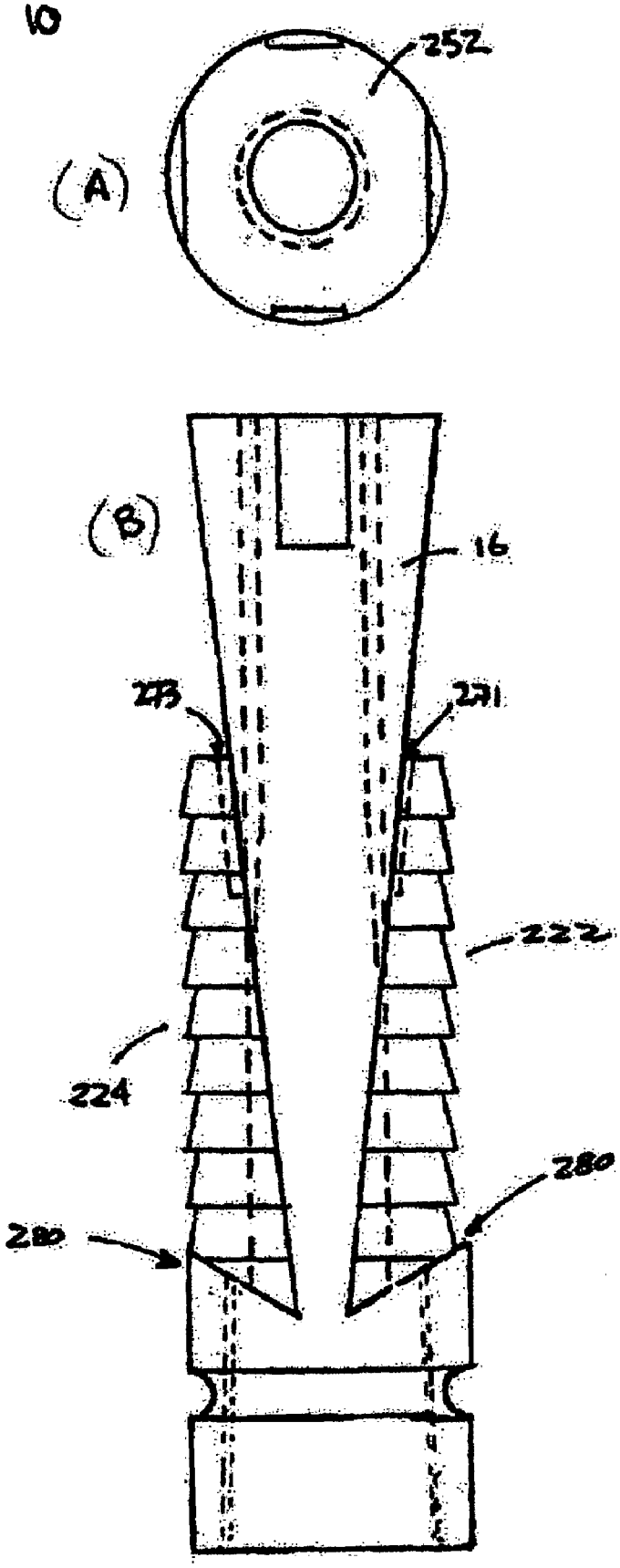
FIG. 10 is an illustration showing the outer shells fixed to the main body of my invention using a unique dove tail joint.

Referring to FIG. 9 there is shown front (Illustration A) side (Illustration B) and bottom views (Illustrations C and D) of one of the pair of opposed outer shells (222) and (224). The shells are semi-circular in cross-section as shown in Illustrations C and D. The inside surface (270) is curved and adapted to sit astride rock bolt (220) across a length delineated by the inverse "V" (274) shown in Illustration A. Each of the outer shells has a plurality of evenly spaced serrations (276) which are adapted for engagement with the wall of the drilled hole. The shells have a bottom surface which is flat in elevation view and inclined upwards in profile view (278) having a second predetermined angle equal to the first predetermined angle (264) of the surface (260) of the main body (16). In this way, the outer shells are held in position in a dove tail joint as illustrated in FIG. 10 Illustration B which shows outer shells (222) and (224) carried on main body (16) and held in position by the dove tail joint (280) which is a novel and inventive feature of my invention. FIG. 10 Illustration A shows the flat top surface of the main body. The shells also include notches (271) and (273) on their respective top inside surfaces. These notches are adapted to receive the engagement ends of the third pair of opposed legs of the third bail as explained below and illustrated in FIG. 6.

The Third Bail

Figure 11:
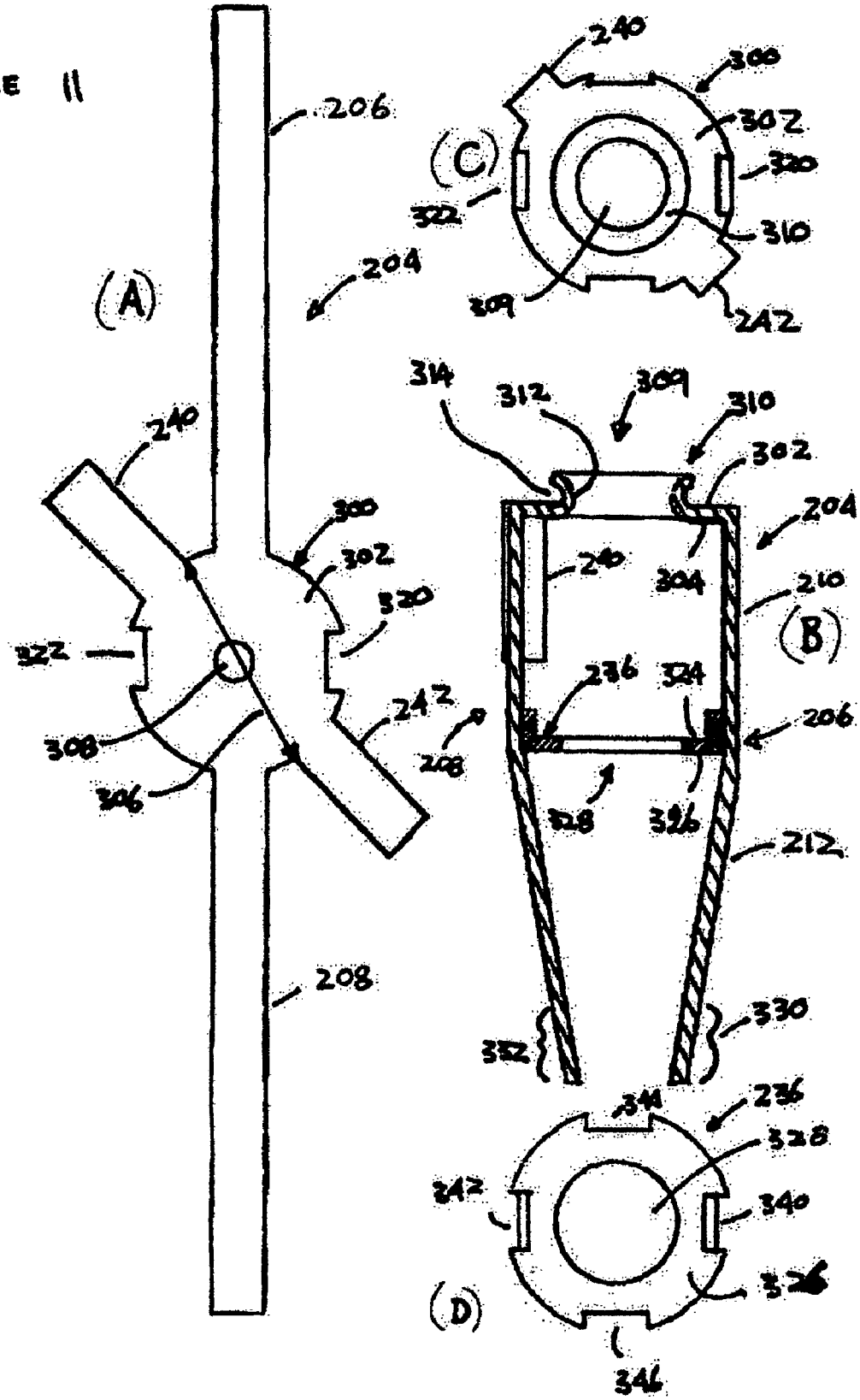
FIG. 11 is an illustration of the third bail of my invention.

Refer now to FIG. 11 there is shown the third bail (200) of my invention. Illustration A shows the third bail having been stamped from suitable sheet metal stock. FIG. 11, illustration B shows the third bail in its formed shape as shown in FIG. 6. FIG. 11, illustration C is a top view of the formed third bail and FIG. 11 illustration D is a bottom view of baffle member (236). Third bail (204) comprises a flat circular middle portion (300) placed across the axis of the rock bolt anchor (8). Middle portion (300) has an upper surface (302), a lower surface (304), a diameter (306), and a third bail aperture (308) centered on the rock bolt anchor axis (8). The third bail aperture (308) is further shaped into aperture (309) formed having flared rim (310) with convex wall (312) surrounding the aperture and creating a concave circular flange (314) around the outside of the aperture. Middle portion (300) has first notch (320) and a second opposed notch (322) adapted for receiving the first pair of opposed legs (50) and (70) respectively of the first bail (26). The third bail includes a third pair of opposed legs (206) and (208) each of which have a bottom engagement portion (330) and (332) for engaging and fixation to notches (271) and (273) of the outer shells in a permanent manner by spot welding. Each leg on the third bail has a first vertical portion (210) and an inclined portion (212). The inclined portion fits over the main body tapers as shown in FIG. 6.

Still referring to FIG. 11, illustration A, the third bail includes a pair of anti-rotation tabs (240) and (242) which extend outwards from the top surface (302) of the middle portion (300) and then depend downwards to engage the wall of the drilled hole in a frictional fit so the anchor does not rotate when the bolt is rotated. This is shown Illustration B at item (240). The tabs are displaced 45 degrees counter-clockwise from each leg of the third pair of legs.

Referring to FIG. 11 Illustration C, there is shown a top view of third bail (204) as it would appear installed in the lower portion of the rock bolt anchor. Notches (320) and (322) are adapted to engage the inside surfaces (58) and (78) of the legs (50) and (70) of the first bail of the top portion.

FIG. 11, Illustration D shows the baffle member (236) fixed permanently by spot welding between the legs of the third bail. The baffle has a top surface (324) and a bottom surface (326) and an opening (328) for passing the rock bolt (220). The baffle (236) is placed on top of the main body (16) as illustrated in FIG. 6. Notches (340) and (342) engage the inside surfaces of third bail legs (206) and (208) and notches (344) and (346) engage the inside surfaces of first bail legs (50) and (70).

The Lance

Figure 12:
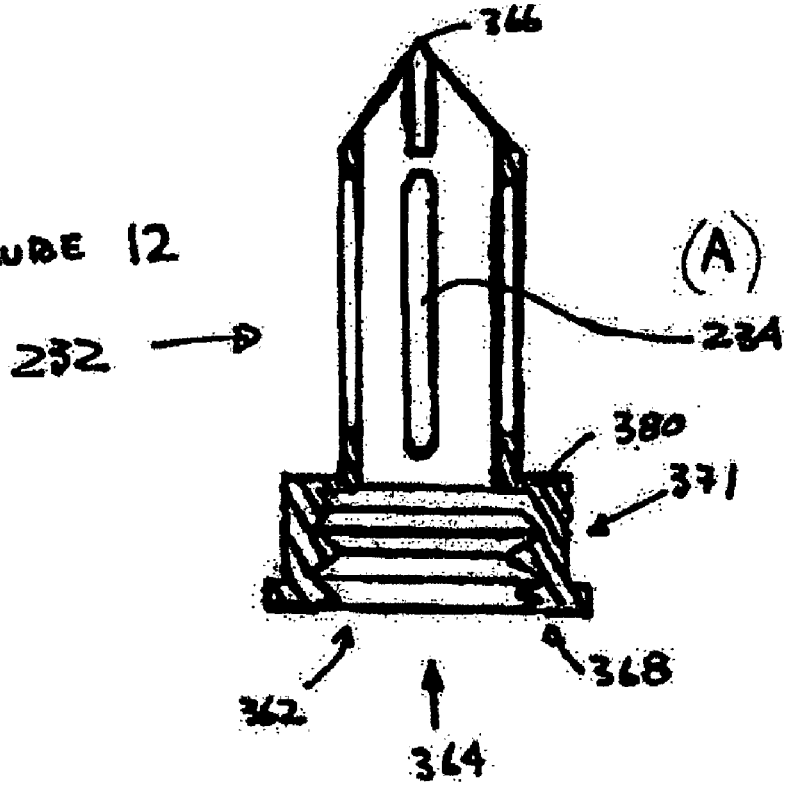
FIG. 12 is an illustration of the lance of my invention.
Figure 12:
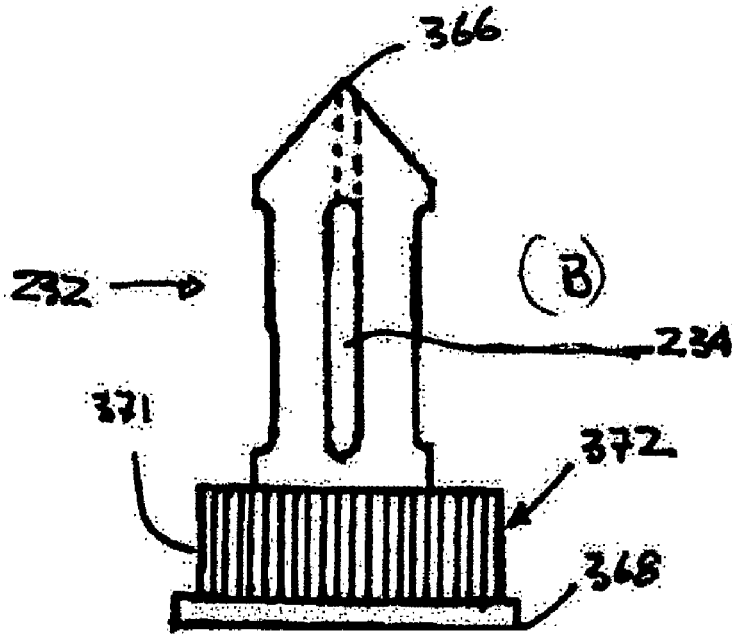

Refer now to FIG. 12 there is shown two illustrations A and B of the lance (232). Figure A shows the lance in cross-section. The lance has a set of threads (362) adapted to receive the threaded end of the rock bolt. As previously described, when the lance is threaded on the end of the rock bolt it has the effect of fixing the entire anchor to the rock bolt. The lance is a hollow cylindrical member having a lumen (364) extending from its sharp free end tip (366) to its opposite end (368). The lance is ported (234) in four locations around its circumference to permit resin to flow from the lumen through the ports and into the annulus. The lance base (371) is knurled (372) around its bottom circumference to assist in finger tightening of the lance onto the end of the rock bolt. The base includes a threaded bore that is in communications with lumen. In operation and as more fully explained below, as the rock bolt is rotated and advances through the main body, the lance will rise to engage and pierce the pressurized resin package. The spring loaded resin release mechanism previously described forces the resin out into the lumen of the lance, through the ports and between the top and bottom bulkheads thereby forming a strong chemical anchor. The top surface (380) of the base of the lance will abut against the bottom surface (304) of the third bail forcing it upwards with the two outer shells. As well the main body will be forced downwards by the rotating rock bolt engaging the standard threads of the bore in the main body. The effect is to force the shells out against the wall of the drilled hole thereby mechanically anchoring the rock bolt.

The Top and Bottom Bulkheads

Figure 13:
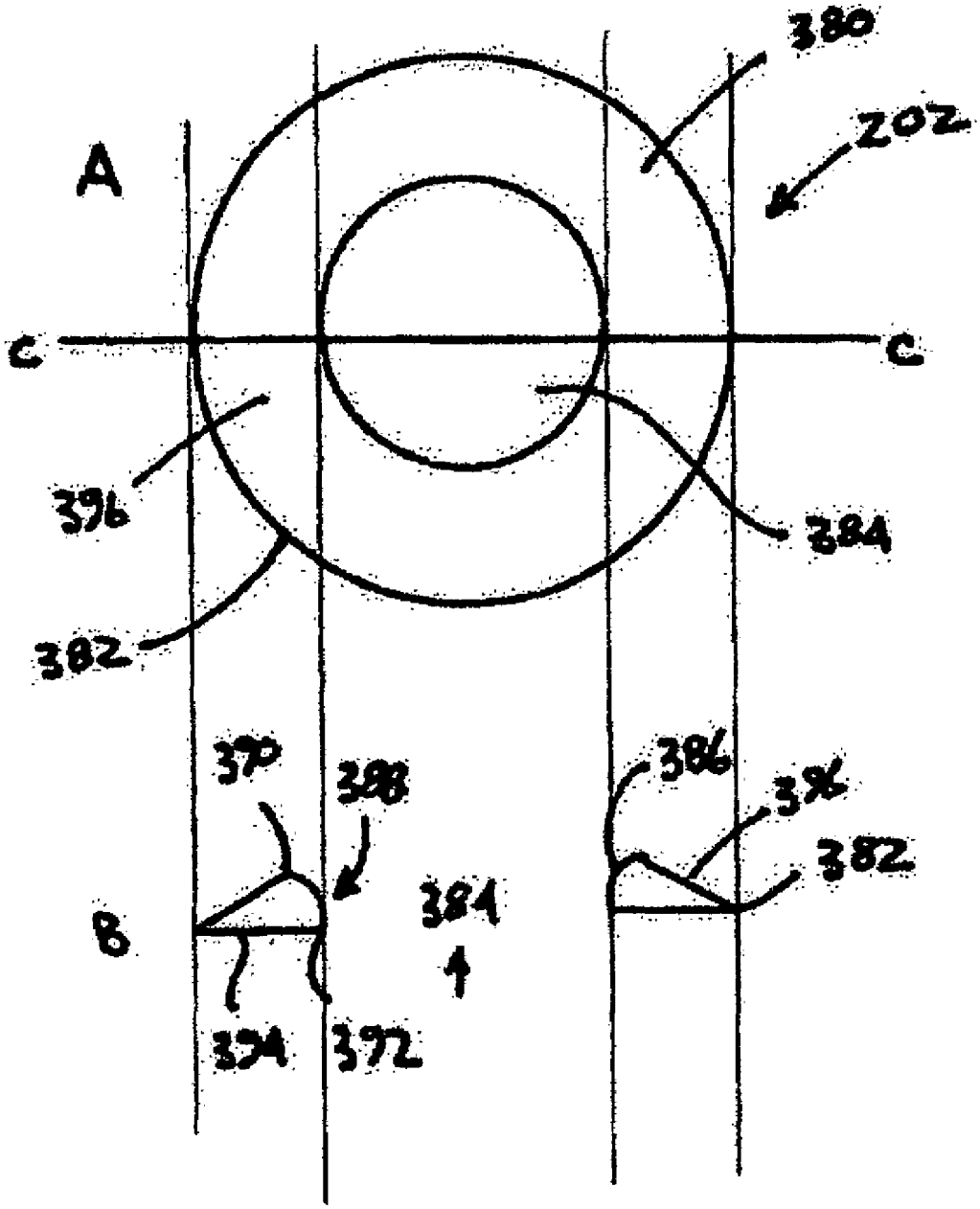
FIG. 13 is an illustration of the top bulkhead of one embodiment of my invention.
Figure 14:
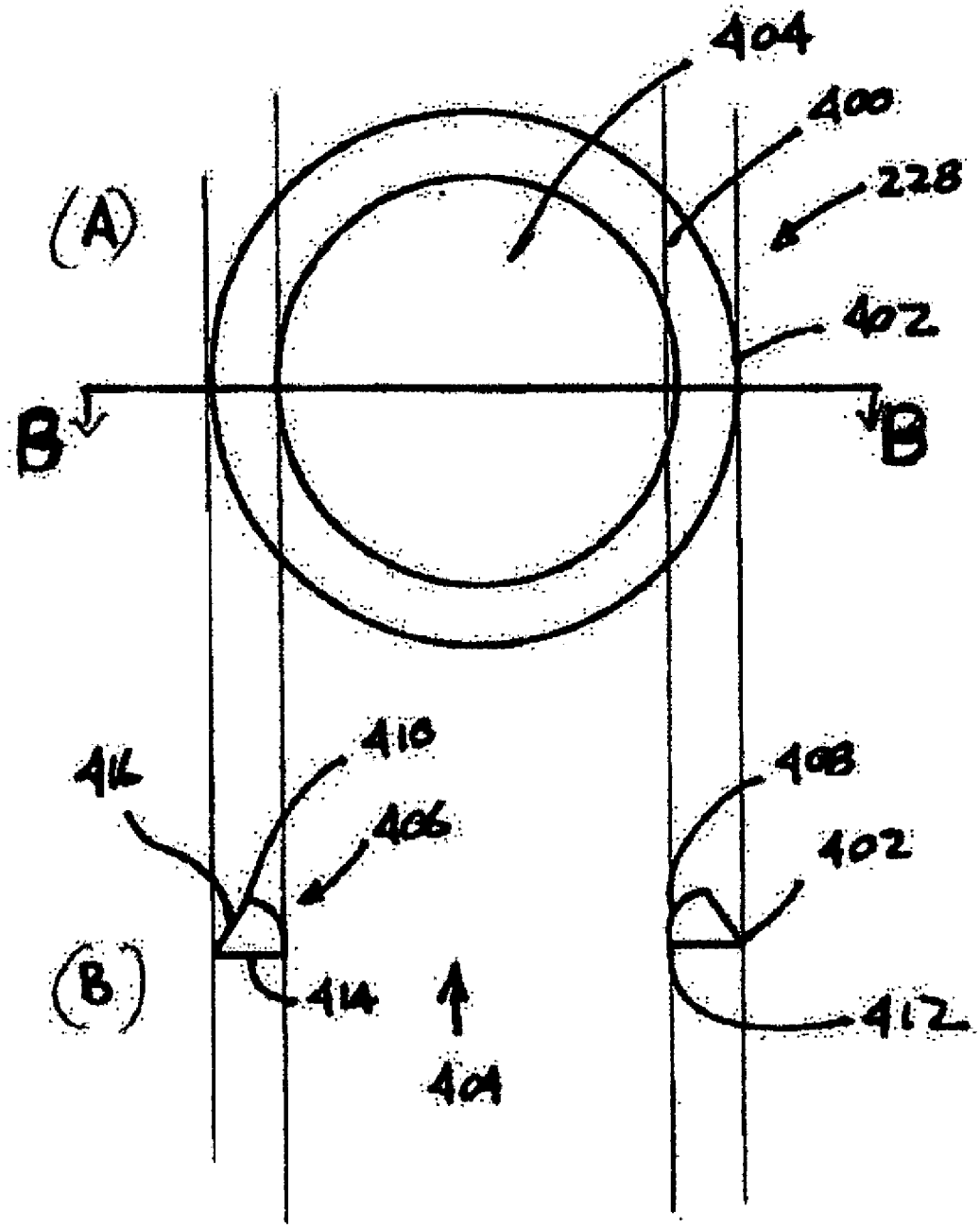
FIG. 14 is an illustration of the bottom bulkhead of one embodiment of my invention.

Refer now to FIGS. 13 and 14. A novel feature of my invention is the use of top and bottom bulkheads to seal a portion of the annulus so that the resin is forced into a defined area and is not allowed to flow beyond that area. This concentrates the resin in a specific location and affords a much stronger chemical bond instead of letting the resin flow freely in the drilled hole annulus as done in the prior art. Referring now to FIG. 13, Illustration A shows the top bulkhead (202) in elevation view and illustration B shows the top bulkhead in cross-sectional view through line C-C. The top bulkhead comprises a first tapered ring member (380) comprising an outside tip (382) in sealing contact with the wall of the drilled hole. An aperture (384) is surrounded by a convex rim (386) having an inside surface (388), a top end (390) and a bottom end (392). The inside surface (388) of the convex rim (386) is adapted to fit within the concave circular flange (314) of the third bail (204). The top bulkhead further has a flat bottom surface (394) that rests upon the top surface (302) of the third bail. There is an inclined upper surface (396) extending from said top end (390) of the convex wall (386) to the tip (382). In operation, the top bulkhead is a flexible material such as resilient rubber with sufficient elastic strength to seal the upper end of the annulus and is installed on the flange as shown in FIG. 6.

Referring to FIG. 14, Illustration A shows the bottom bulkhead (228) in plan view and Illustration B shows the bottom bulkhead in cross-sectional view through line C-C. The bottom bulkhead comprises a second tapered ring member (400) comprising an outside tip (402) in sealing contact with the wall of the drilled hole. An aperture (404) is surrounded by a convex rim (406) having an inside surface (408), a top end (410) and a bottom end (412). The inside surface (408) of the convex rim is adapted to fit within the circumferential groove (266) of the main body (16).

The bottom bulkhead further includes a flat bottom surface (414) extending from the bottom end (412) of the convex wall and extending to the tip (402) of the ring member (400) and an inclined upper surface (416) extending from the top end (410) of the convex wall to the tip of the tapered ring member. The second tapered ring is made from the same material as the first tapered ring and operates in a similar fashion.

Another advantage to my invention is that the rock bolt anchor can be secured to the rock bolt as one single unit comprising the top portion and the bottom portion with the two outer shells. The anchor is easily threaded onto the end of the rock bolt and secured using the lance.

The Operation of My Invention

Referring to FIG. 15, there is shown a preferred embodiment of my invention placed in a drilled hole (500) having a wall (502). Note how the top bulkhead (202) and the bottom bulkhead (228) seal a portion (504) of the annulus (506) between the rock bolt anchor and the wall of the drilled hole. The package of resin (12) is shown in the open chamber. Since the wing nut (138) has been removed the spring (150) is free to exert compressive forces on the resin package (12) thereby pressuring the contents. The resin package bulges on its side to show pressurized contents. When the rock bolt (220) is rotated the lance (232) rises to a piercing engagement with the resin package. Resin is forced through the lumen in the lance and out of the ports and into the area of the annulus (504) between the top and bottom bulkheads. This keeps the resin confined to a defined space and increases the chemical bond of the rock bolt to the wall of the drilled hole. The annulus portion (504) will fill completely with resin encapsulating the rock bolt anchor between the bulkheads.

Referring now to FIG. 16, there is shown my invention in a drilled hole (500) having a wall (502). The top bulkhead (202) and the bottom bulkhead (228) are shown in sealing contact with the wall (502) of the drilled hole. The area (504) between the top and bottom bulkheads is filled with resin from the depleted resin package (12) which has been compressed and emptied by the spring loaded resin release mechanism (30). Note that lance (232) has plunged deeply into the resin package. The rock bolt (220) threads (221) have rotated a distance (520) above the baffle member (236) until the top surface (380) of the lance base (371) abuts against the underside (304) of third bail (204). Once the rotating rock bolt advances to this point it advances no further and continued rotation of the rock bolt within the multiple threaded main body causes the main body to travel downwards. This, in turn, separates the shells (222) and (224) from the main body (16) and causes them to ride up the tapered portion of the main body (16) and outwards so that the serrated edges are in firm contact with the wall of the drilled hole creating a mechanical bond with between the rock bolt and the wall of the drilled hole.

Figure 17:
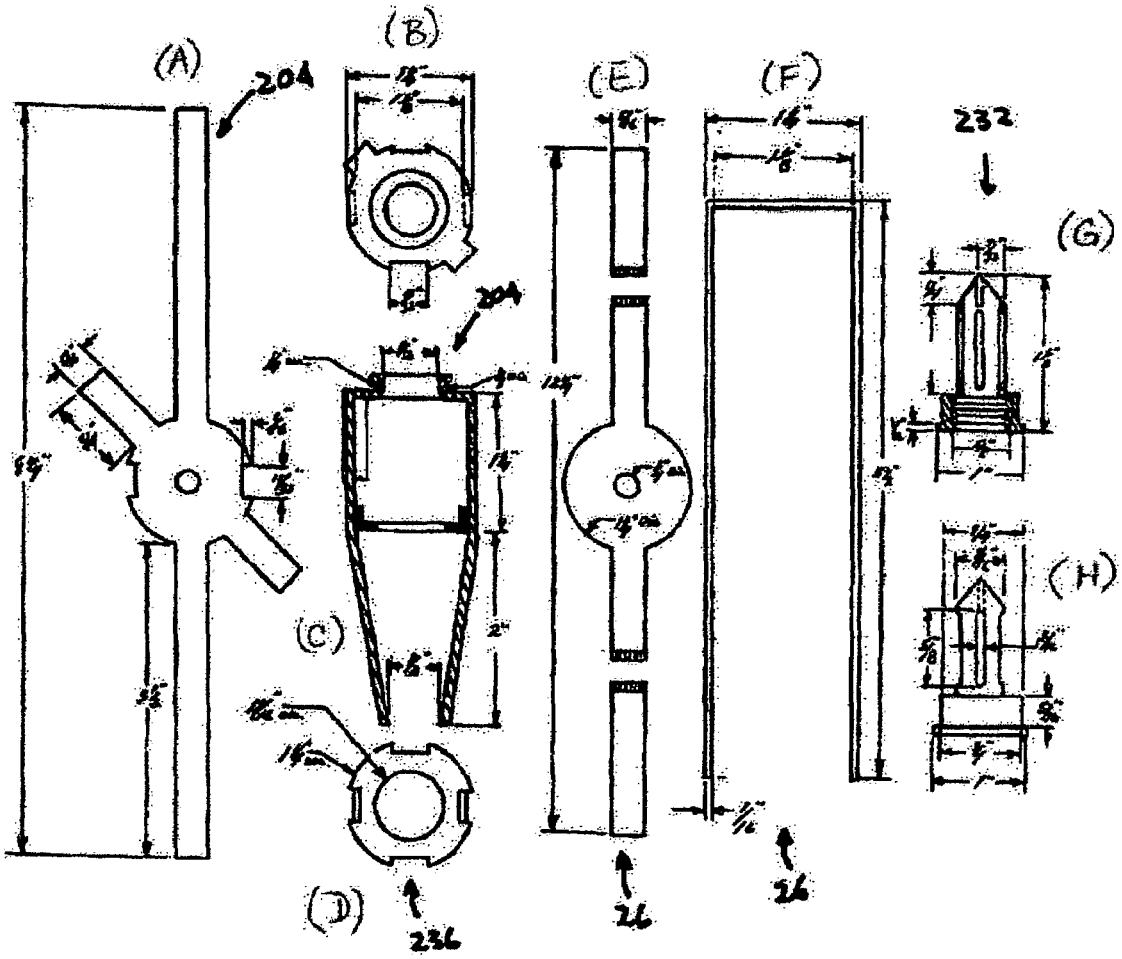
FIG. 17 comprises various illustrations of components of my invention showing dimensions.
Figure 18:
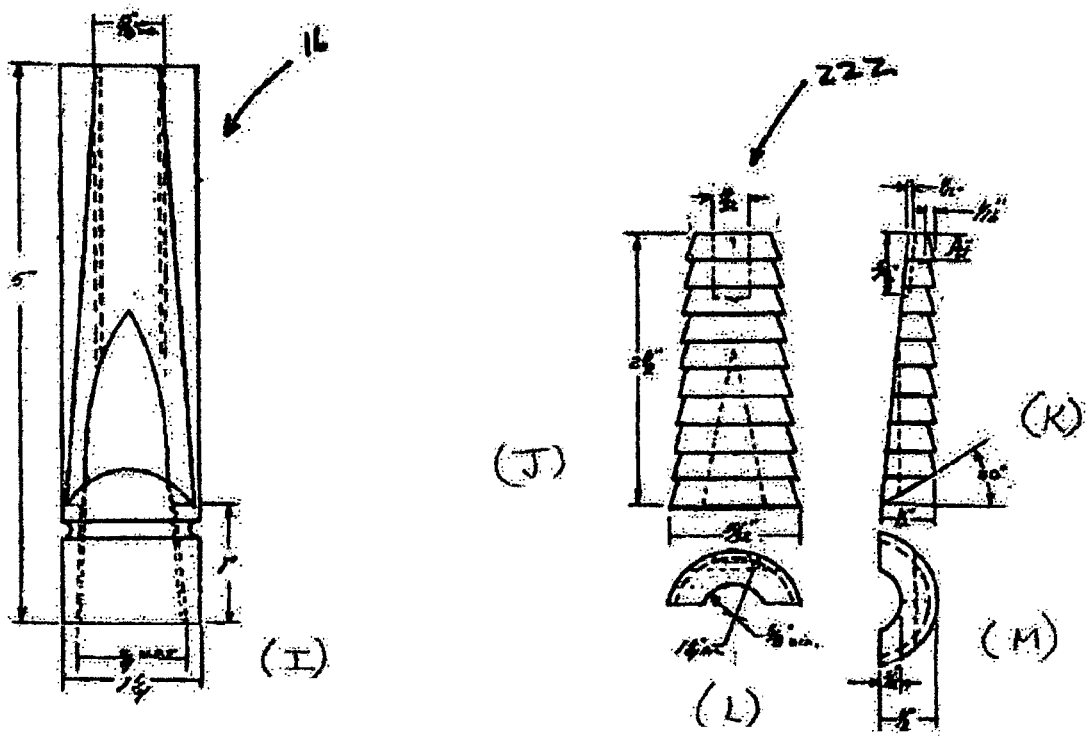
FIG. 18 comprises various illustrations of components of my invention showing dimensions.

Referring now to FIGS. 17 and 18, there is shown various components of my invention previously described illustrating dimensions of one embodiment of my invention. Understandably, these dimensions may change to manufacture my rock bolt anchor to suit the needs of the rock bolting operation.

Method of Use

My invention as described herein can be employed in rock bolting operations by following these steps:

a. selecting a rock bolt having a threaded end;
b. selecting a rock bolt anchor having a top portion and a bottom portion;
c. threading said rock bolt threaded end into said rock bolt anchor bottom portion main body so that at least three threads of the threaded end of the rock bolt protrude above said main body;
d. selecting a lance;
e. threading said lance onto said threads protruding above the main body thereby fixing the rock bolt anchor to the rock bolt;
f. loading a package of adhesive resin into said top portion;
g. removing said wing nut thereby releasing said spring loaded resin release mechanism to come into compressive contact with said package of adhesive resin thereby pressurizing the contents thereof;
h. inserting the rock bolt anchor and rock bolt into the drilled hole so that the rock bolt anchor is placed in a desired location within the drilled hole;
i. sealing said desired location within the drilled hole between the top bulkhead and the bottom bulkhead;
j. rotating the rock bolt in a clockwise direction so that the lance rises into piercing contact with the package of adhesive resin causing the spring loaded resin release mechanism to squeeze the contents of the resin package into the lumen within the lance and out of the ports within the lance into the desired location within the drilled hole between the top and bottom bulkheads so that the entire bottom portion of the rock bolt is encased in resin thereby chemically anchoring the rock bolt in the drilled hole; and,
k. continuing the rotation of the rock bolt so that the third bail and the outer shells attached to the third bail are driven upwards and further so that the main body is driven downwards thereby causing the outer shells to move up the tapers of the main body and into firm contact with the wall of the drilled hole thereby mechanically anchoring the rock bolt into the drilled hole.

Although the description above contains many specifications, these should not be construed as limiting the scope of the invention but as merely providing illustrations of some of the presently preferred embodiments of this invention. Thus the scope of the invention should be determined by the appended claims and their legal equivalents rather than by the examples given.

What is claimed is:

1. A rock bolt anchor having chemical and mechanical means for anchoring a rock bolt in a drilled hole having a wall, said rock bolt anchor attached to the threaded end of said rock bolt and inserted into said drilled hole thereby forming an annulus having a top and a bottom, said annulus located between said wall of the drilled hole and the rock bolt anchor, wherein the rock bolt anchor comprises:

a. a top portion having a longitudinal axis and adapted to protectively carry said chemical means, wherein the chemical means comprises a package of adhesive resin adapted to fill said annulus thereby chemically anchoring the rock bolt into the drilled hole; and;
b. a co-axial bottom portion fixed permanently to said top portion, wherein said bottom portion is adapted to carry said mechanical means, and wherein the mechanical means comprises a pair of opposed outer shells adapted to move into a binding contact with the wall of the drilled hole thereby mechanically anchoring the rock bolt into the drilled hole;

wherein the top portion comprises:

a first bail for fixing said top portion to said bottom portion;
a second bail co-axial with said first bail and positioned underneath the first bail; and,
a spring loaded resin release mechanism for compressing said package of adhesive resin and then forcing the resin contained in the package of adhesive resin out of the package and into the annulus.

2. The rock bolt anchor as claimed in claim 1, wherein the first bail comprises:

a. a flat circular middle portion for placement across the axis, said flat circular middle portion comprising:
i. an upper surface;
ii. a bottom surface;
iii. a diameter; and,
iv. a first bail aperture centered on the axis;
b. a first pair of opposed legs depending vertically downwards from the flat circular middle portion, wherein each of said first pair of opposed legs comprises:
i. a lower engagement portion;
ii. a length;
iii. an inside surface; and,
iv. an outside surface.

3. The rock bolt anchor as claimed in claim 2, wherein the second bail comprises:

a. a flat circular middle portion for placement across said axis, said flat circular middle portion comprising:
i. a first notch for receiving in a sliding engagement said inside surface of one leg of said first pair of opposed legs;
ii. a second notch for receiving in a sliding engagement said inside surface of the opposite leg of the first pair of opposed legs;
iii. an upper surface;
iv. a bottom surface;
v. adiameter;and,
vi. a second bail aperture centered on the axis;
b. a second pair of opposed legs depending vertically downwards from the flat circular middle portion, wherein each leg of said second pair of opposed legs comprises:
i. a length substantially shorter than said length of the first pair of opposed legs;
ii. an inside surface; and,
iii. an outside surface;

wherein the first bail and the second bail are oriented such that the first and second pair of opposed legs are at ninety degrees to each other thereby forming a four sided open chamber adapted to protectively receive said package of adhesive resin.

4. The rock bolt anchor as claimed in claim 3, wherein said spring loaded resin release mechanism comprises:

a. a top hat-shaped member having a lower circular flange and an upper cylindrical portion having a circular top surface, wherein said lower circular flange has a top and bottom surface and four equally spaced notches, and wherein said four equally spaced notches receive, in a sliding relationship, said inside surfaces of the first and second pair of opposed legs, so that the lower circular flange is guided up and down within the open chamber by the first and second pair of opposed legs;

b. a threaded stem having a first end fixed to the center of said circular top surface and a free second end adapted to receive a wing nut, wherein said threaded stem receives the apertures of the first and second bails so that said top hat-shaped member sits within the open chamber; and, c. a spring disposed around said upper cylindrical portion, said spring having a top and a bottom, such that said top of the spring abuts against said bottom surface of the second bail flat circular middle portion and said bottom of the spring abuts against said top surface of the lower circular flange.

5. The rock bolt anchor as claimed in claim 4, wherein the spring loaded resin release mechanism includes:

a. a first operating state, wherein said wing nut is threaded onto the threaded stem and tightened so that the spring is compressed and the lower circular flange is withdrawn so that the open chamber is able to receive a resin package;

b. a second operating state, wherein the resin package sits within the open chamber and the wing nut is removed so that the spring is released resulting in the bottom surface of the lower circular flange contacting and compressing the resin package thereby pressurizing its contents, and wherein said second operating state occurs prior to insertion of the rock bolt anchor into the drilled hole; and, c. a third operating state, wherein the resin package has been pierced and the resin squeezed from the resin package so that the spring is fully extended within the open chamber.

6. The rock bolt anchor as claimed in claim 1, wherein said bottom portion comprises:

a. a top bulkhead adapted for sealing said top of the annulus;

b. a third bail adapted for carrying said top bulkhead;

c. a main body having a top portion and a bottom portion, said bottom portion having a circumferential groove, wherein said main body further comprises a threaded central bore having standard threads and adapted for receiving the threaded end of the rock bolt;

d. a pair of opposed outer shells carried by the main body in a sliding relationship, wherein said pair of opposed outer shells are held on the main body by a dove tail joint;

e. a bottom bulkhead adapted for sealing said bottom of the annulus; and, f. a lance for piercing the resin package.

7. The rock bolt anchor as claimed in claim 6, wherein:

a. said main body top portion has a flat circular top surface;

b. the main body bottom portion has a top surface;

c. the main body further comprises:

i. a pair of opposed tapers having an outside surface and commencing at said top portion flat circular top surface and depending a predetermined distance to said bottom portion top surface, wherein said tapers terminate in a dove tail which angles said top surface of the bottom portion outwards and upwards at a first predetermined angle, and further wherein each taper of the pair of opposed tapers includes a rectangular notch on its top portion outside surface, said notch adapted to receive in a permanent and flush relationship the engagement ends of the first pair of opposed legs thereby connecting the top portion of the rock bolt anchor to the bottom portion of the rock bolt anchor; and, ii. a ¾ inch pipe thread within the bottom portion so that the main body may be attached to a source of grout for grouting the drilled hole as necessary.

8. The rock bolt anchor as claimed in claim 7, wherein said central bore is threaded with a multiple thread adapted for passing the threaded rock bolt through the main body in an accelerated fashion.

9. The rock bolt anchor as claimed in claim 7, wherein said each shell of said pair of opposed shells are identical and semi-circular, and wherein each shell comprises:

a. a top portion having a flat top surface in elevation view;

b. a bottom portion having a bottom surface that is flat in elevation view and inclined upwards in profile view at a second predetermined angle, said second predetermined angle equal to said first predetermined angle so that when the opposite shells are placed upon the main body, said upwardly inclined bottom surface meshes with said dove tail thereby holding the pair of opposed shells firmly in place;

c. an inside surface having a curved inner profile so that said inside surface is able to sit astride the rock bolt;

d. an outside surface comprising a plurality of serrations adapted for engagement with the wall of the drilled hole; and, e. a rectangular notch on the inside surface of the top portion.

10. The anchor bolt as claimed in claim 9, wherein said third bail comprises:

a. a flat circular middle portion placed across the axis, said flat circular middle portion comprising:

i. an upper surface;

ii. a lower surface;

iii. a diameter; and, iv. a third bail aperture centered on the axis, b. a third pair of opposed legs, wherein each leg of said third pair of opposed legs comprises:

i. a bottom engagement portion;

ii. an inside surface;

iii. a length;

iv. an outside surface;

v. a first vertical portion; and, vi. a second portion inclined towards the axis;

wherein said bottom engagement portion of each leg of said third pair of opposed legs is adapted to permanently engage in a flush relationship said rectangular notch in each shell of said pair of opposed shells.

11. The rock bolt anchor as claimed in claim 10, wherein said third bail aperture further comprises a flared rim having an upper surface thereby forming a convex wall surrounding the third bail aperture and further creating a concave circular flange, wherein said concave circular flange is adapted to receive the top bulkhead.

12. The rock bolt anchor as claimed in claim 11, wherein said third bail flat circular middle portion further comprises a pair of opposed notches, wherein each notch of said pair of opposed notches is adapted to receive the inside surface of one of the legs of the first pair of opposed legs.

13. The rock bolt anchor as claimed in claim 12, wherein the bottom portion of the rock bolt anchor further includes a baffle member fixed between the pair of opposed legs of the third bail, said baffle member disposed on the top surface of the main body, wherein the baffle member comprises:

a. a top surface;
b. a bottom surface;
c. a central opening adapted to pass the rock bolt; and,
d. a first and second pair of opposed notches, wherein said first pair of opposed notches is adapted to permanently receive the inside surfaces of the first pair of opposed legs, and wherein said second pair of opposed notches is adapted to permanently receive the inside surfaces of the third pair of opposed legs.

14. The rock bolt anchor as claimed in claim 13, wherein said lance comprises:
a. a hollow cylindrical member comprising:
i. a lumen;
ii. a sharp free end adapted for piercing the resin package;
iii. an opposite end; and,
iv. a plurality evenly spaced ports;
b. a knurled base to which said opposite end of said lumen is fixed, said knurled base having:
i. a threaded bore communicating with the lumen and adapted for receiving the threaded end of the rock bolt;
ii. a top surface for contacting the bottom surface of the third bail flat circular middle portion when the lance is in piercing contact with the package of resin; and,
iii. a bottom surface adapted for placement on the top surface of the baffle member.

15. The rock bolt anchor as claimed in claim 14, wherein once the rock bolt anchor is inserted into the drilled hole and the annulus sealed by the top and bottom bulkheads, the rock bolt is rotated thereby raising the lance into piercing contact with the package of resin until the top surface of the knurled base is in contact with the bottom surface of the third bail flat circular middle portion, so that the resin is forced out of the package by the spring loaded resin release mechanism and into the lumen subsequently flowing out of said plurality of ports into the annulus the result being that all of the resin contained in the resin package surrounds the rock bolt anchor within the annulus and sets to chemically anchor the rock bolt in the drilled hole.

16. The rock bolt anchor as claimed in claim 15, wherein the top bulkhead comprises a tapered ring comprising:
a. an outside tip in sealing contact with the wall of the drilled hole;
b. an aperture surrounded by a convex rim having an inside surface, a top end and a bottom end, wherein said convex rim inside surface is adapted to fit within said concave circular flange of the third bail aperture;
c. a flat bottom surface extending from said bottom end of the convex wall to the tip of said tapered ring member, wherein said flat bottom surface rests upon the upper surface of the third bail flat circular middle portion; and,
d. an inclined upper surface extending from said top end of the convex wall to the tip of the tapered ring member.

17. The rock bolt anchor as claimed in claim 16, wherein the bottom bulkhead comprises a second tapered ring member comprising:
a. an outside tip in sealing contact with the wall of the drilled hole;
b. an aperture surrounded by a convex rim having an inside surface, a top end and a bottom end, wherein said convex rim inside surface is adapted to fit within the circumferential groove on the main body;
c. a flat bottom surface extending from said bottom end of the convex wall and extending to the tip of said second tapered ring member; and,
d. an inclined upper surface extending from said top end of the convex wall and extending to the tip of the tapered ring member.

18. A method of using a rock bolt anchor having concurrent chemical and mechanical means for anchoring a rock bolt in a drilled hole having a wall, the rock bolt anchor comprising a top portion having a longitudinal axis, a spring loaded resin release mechanism retracted by a wing nut and adapted to protectively carry said chemical means, wherein the chemical means comprises a package of adhesive resin adapted to bind the rock bolt anchor into the drilled hole; and, a co-axial bottom portion fixed permanently to said top portion, wherein said bottom portion is adapted to carry said mechanical means, and wherein the mechanical means comprises a main body having a threaded central bore, wherein said main body is adapted to carry pair of opposed outer shells adapted to move into a binding contact with the wall of the drilled hole, said method comprising the following steps:
a. selecting a rock bolt having a threaded end;
b. selecting a rock bolt anchor having a top portion and a bottom portion;
c. threading said rock bolt threaded end into said rock bolt anchor bottom portion main body so that at least three threads of the threaded end of the rock bolt protrude above said main body;
d. selecting a lance;
e. threading said lance onto said threads protruding above the main body thereby fixing the rock bolt anchor to the rock bolt;
f. loading a package of adhesive resin into said top portion;
g. removing said wing nut thereby releasing said spring loaded resin release mechanism to come into compressive contact with said package of adhesive resin thereby pressurizing the contents thereof
h. inserting the rock bolt anchor and rock bolt into the drilled hole so that the rock bolt anchor is placed in a desired location within the drilled hole;
i. sealing said desired location within the drilled hole between the top bulkhead and the bottom bulkhead;
j. rotating the rock bolt in a clockwise direction so that the lance rises into piercing contact with the package of adhesive resin causing the spring loaded resin release mechanism to squeeze the contents of the resin package into the lumen within the lance and Out of the ports within the lance into the desired location within the drilled hole between the top and bottom bulkheads so that the entire bottom portion of the rock bolt is encased in resin thereby chemically anchoring the rock bolt in the drilled hole;
k. continuing the rotation of the rock bolt so that the third bail and the outer shells attached to the third bail are driven upwards and further so that the main body is driven downwards thereby causing the outer shells to move up the tapers of the main body and into firm contact with the wall of the drilled hole thereby mechanically anchoring the rock bolt into the drilled hole.

* * * * *